US011066775B2

(12) United States Patent
Romito et al.

(10) Patent No.: US 11,066,775 B2
(45) Date of Patent: Jul. 20, 2021

(54) METHOD AND APPARATUS FOR CLEANING LAUNDRY

(71) Applicant: Electrolux Appliances Aktiebolag, Stockholm (SE)

(72) Inventors: Helena Romito, Charlotte, NC (US); Allison White, Charlotte, NC (US); Yihong Li, Charlotte, NC (US); Oscar Madalena, Charlotte, NC (US)

(73) Assignee: Electrolux Appliances Aktiebolag

( * ) Notice: Subject to any disclaimer, the term of this patent is extended or adjusted under 35 U.S.C. 154(b) by 16 days.

(21) Appl. No.: 16/131,757

(22) Filed: Sep. 14, 2018

(65) Prior Publication Data

US 2020/0087837 A1 Mar. 19, 2020

(51) Int. Cl.
*D06F 21/04* (2006.01)
*D06F 33/00* (2020.01)
(Continued)

(52) U.S. Cl.
CPC ..... *D06F 39/028* (2013.01); *D06F 21/04* (2013.01); *D06F 33/00* (2013.01); *D06F 34/18* (2020.02);
(Continued)

(58) Field of Classification Search
CPC ..... D06F 21/04; D06F 33/00; D06F 34/18; D06F 35/006; D06F 35/007; D06F 37/04; D06F 37/28; D06F 37/304; D06F 39/02; D06F 39/028; D06F 39/088; D06F 39/10; D06F 2202/04; D06F 2202/085;
(Continued)

(56) References Cited

U.S. PATENT DOCUMENTS 2,821,848 A 2/1958 Becker
2,933,912 A 4/1960 Billings
(Continued)

FOREIGN PATENT DOCUMENTS

BR 202014023113 Y1 12/2019
DE 19537671 A1 4/1997
(Continued)

OTHER PUBLICATIONS

International Search and Written Opinion for International Application No. PCT/EP2019/072846, dated Oct. 22, 2019, 11 pages.
(Continued)

*Primary Examiner* — Levon J Shahinian
(74) *Attorney, Agent, or Firm* — RatnerPrestia

(57) ABSTRACT

A laundry washing machine having: a casing, a washing tub located within the casing, a drum mounted within the washing tub and configured to rotate relative to the casing, a door attached to the casing and being openable to provide access to the drum, an additive loading and supply system configured to receive loose detergent, one or more valves configured to selectively provide water to the additive loading and supply system, a tub supply pipe fluidly connecting the additive loading and supply system to the drum, a receptacle configured to receive a unit dose package comprising a water soluble pouch containing a dose of cleaning product, and means for breaking the unit dose package outside the additive loading and supply system.

15 Claims, 12 Drawing Sheets

(51) Int. Cl.

| | |
|---|---|
| ***D06F 34/18*** | (2020.01) |
| ***D06F 35/00*** | (2006.01) |
| ***D06F 37/04*** | (2006.01) |
| ***D06F 37/28*** | (2006.01) |
| ***D06F 37/30*** | (2020.01) |
| ***D06F 39/02*** | (2006.01) |
| ***D06F 39/08*** | (2006.01) |
| ***D06F 39/10*** | (2006.01) |

(52) U.S. Cl.
CPC ..... *D06F 37/04* (2013.01); *D06F 37/28* (2013.01); *D06F 37/304* (2013.01); *D06F 39/088* (2013.01); *D06F 39/10* (2013.01); *D06F 35/006* (2013.01); *D06F 35/007* (2013.01); *D06F 2202/04* (2013.01); *D06F 2202/085* (2013.01); *D06F 2202/10* (2013.01); *D06F 2210/00* (2013.01); *D06F 2222/00* (2013.01); *D06F 2224/00* (2013.01)

(58) Field of Classification Search
CPC ..... D06F 2202/10; D06F 2210/00; D06F 2222/00; D06F 2224/00
USPC ..... 68/3 R, 17 R; 222/145.5
See application file for complete search history.

(56) References Cited

U.S. PATENT DOCUMENTS

| | | | |
|---|---|---|---|
| 4,882,917 | A | 11/1989 | Mizusawa et al. |
| 5,884,506 | A | 3/1999 | Blauert et al. |
| 7,036,177 | B2 | 5/2006 | Aouad et al. |
| 7,181,934 | B2 | 2/2007 | Hsu et al. |
| 8,931,311 | B2 | 1/2015 | Leibman et al. |
| 9,271,627 | B2 | 3/2016 | Alexander et al. |
| 9,574,297 | B2 | 2/2017 | Berndsen et al. |
| 9,637,857 | B2 | 5/2017 | Del Pos et al. |
| 9,663,893 | B2 | 5/2017 | Malheiros |
| 9,850,618 | B2 | 12/2017 | Burger et al. |
| 9,903,063 | B2 | 2/2018 | Carpenter et al. |
| 9,970,148 | B2 | 5/2018 | Alexander et al. |
| 9,976,246 | B2 | 5/2018 | Malheiros |
| 10,480,113 | B2 | 11/2019 | Favaro et al. |
| 10,519,590 | B2 | 12/2019 | Malheiros |
| 10,731,284 | B2 | 8/2020 | Alexander et al. |
| 10,815,607 | B2 | 10/2020 | Costa et al. |
| 2004/0200245 | A1 | 10/2004 | Cheo et al. |
| 2005/0102767 | A1 | 5/2005 | Aouad et al. |
| 2005/0166645 | A1 | 8/2005 | Favret et al. |
| 2005/0229652 | A1 | 10/2005 | Kim et al. |
| 2005/0241072 | A1 | 11/2005 | Kim et al. |
| 2005/0274156 | A1 | 12/2005 | Yang |
| 2007/0163307 | A1 | 7/2007 | Kramme et al. |
| 2009/0119849 | A1 | 5/2009 | Hill et al. |
| 2009/0293203 | A1 | 12/2009 | Hettinger et al. |
| 2011/0247147 | A1 | 10/2011 | Amos et al. |
| 2012/0060568 | A1 | 3/2012 | Buso et al. |
| 2012/0067089 | A1 | 3/2012 | Buso et al. |
| 2012/0272691 | A1* | 11/2012 | Leibman ..... D06F 23/04 68/17 R |
| 2014/0060121 | A1 | 3/2014 | Burger et al. |
| 2014/0060581 | A1 | 3/2014 | Alexander et al. |
| 2014/0060594 | A1 | 3/2014 | Alexander et al. |
| 2014/0157835 | A1 | 6/2014 | Del Pos et al. |
| 2014/0165663 | A1* | 6/2014 | Celotto ..... D06F 39/083 68/17 R |
| 2015/0013075 | A1 | 1/2015 | Herrera et al. |
| 2015/0059413 | A1* | 3/2015 | Yoo ..... D06F 39/04 68/20 |
| 2015/0267340 | A1 | 9/2015 | Malheiros |
| 2015/0345069 | A1 | 12/2015 | Leibman et al. |
| 2016/0047077 | A1 | 2/2016 | Leibman et al. |
| 2016/0237612 | A1 | 8/2016 | Ghosh et al. |
| 2017/0073877 | A1 | 3/2017 | Hettinger et al. |
| 2017/0297770 | A1 | 10/2017 | Snider et al. |
| 2018/0073185 | A1 | 3/2018 | Burger et al. |
| 2018/0135226 | A1 | 5/2018 | Alexander et al. |
| 2018/0155864 | A1 | 6/2018 | Alexander et al. |
| 2019/0017208 | A1 | 1/2019 | Marangoni et al. |
| 2020/0370229 | A1 | 11/2020 | Bensel et al. |
| 2021/0025103 | A1 | 1/2021 | Li et al. |

FOREIGN PATENT DOCUMENTS

| | | | |
|---|---|---|---|
| EP | 1126070 | A1 | 8/2001 |
| EP | 2025798 | A2 | 2/2009 |
| EP | 2239363 | A1 | 10/2010 |
| EP | 2241669 | A1 | 10/2010 |
| EP | 3037582 | A1 | 6/2016 |
| EP | 3184688 | A1 | 6/2017 |
| EP | 3257998 | A1 | 12/2017 |
| EP | 3293302 | A1 | 3/2018 |
| EP | 2540902 | B1 | 5/2020 |
| EP | 3660198 | A1 | 6/2020 |
| FR | 1209601 | A | 3/1960 |
| GB | 586424 | | 3/1947 |
| GB | 589374 | | 6/1947 |
| JP | 2016073330 | A | 5/2016 |
| WO | 2005059229 | A1 | 6/2005 |
| WO | 2005061685 | A1 | 7/2005 |
| WO | 2007051988 | A1 | 5/2007 |
| WO | 2015197109 | A1 | 12/2015 |
| WO | 2016101994 | A1 | 6/2016 |
| WO | 2016102005 | A1 | 6/2016 |

OTHER PUBLICATIONS

Non Final Office Action for U.S. Appl. No. 16/131,912, dated Aug. 19, 2020, 19 pages.
International Search Report and Written Opinion for International Application No. PCT/EP2014/079129, dated Mar. 23, 2015, 11 pages.
International Search Report and Written Opinion for International Application No. PCT/EP2014/079176, dated Mar. 9, 2015, 9 pages.
International Preliminary Report on Patentability for International Application No. PCT/EP2014/079176, dated Jun. 27, 2017, 7 pages.
International Search Report and Written Opinion for International Application No. PCT/IB2019/000746, dated Jun. 25, 2020, 18 pages.
International Search Report and Written Opinion for International Application No. PCT/EP2017/072466, dated Nov. 10, 2017—11 pages.
International Search Report and Written Opinion for International Application No. PCT/EP2020/068875, dated Sep. 22, 2020, 11 pages.
Notice of Allowance for U.S. Appl. No. 15/537,701, dated May 19, 2020, 9 pages.
Non Final Office Action for U.S. Appl. No. 16/131,935, dated Jan. 25, 2021, 14 pages.
Notice of Allowance for U.S. Appl. No. 16/332,116, dated Jan. 25, 2021, 8 pages.
Non Final Office Action for U.S. Appl. No. 16/522,156, dated Feb. 10, 2021, 46 pages.
Notice of Allowance for U.S. Appl. No. 16/131,912, dated Feb. 22, 2021, 14 pages.
International Search Report and Written Opinion for International Application No. PCT/EP2020/071064, dated Nov. 9, 2020, 14 pages.
Non Final Office Action for U.S. Appl. No. 16/131,921, dated Dec. 22, 2020, 32 pages.
Notice of Allowance for U.S. Appl. No. 16/131,912, dated Dec. 9, 2020, 17 pages.
Final Office Action for U.S. Appl. No. 16/131,921, dated Mar. 19, 2020, 28 pages.
Final Office Action for U.S. Appl. No. 16/131,935, dated Mar. 18, 2021, 21 pages.
Notice of Allowance for U.S. Appl. No. 16/332,116, dated Mar. 19, 2021, 23 pages.

(56) References Cited

OTHER PUBLICATIONS

Non Final Office Action for U.S. Appl. No. 16/131,921, dated Apr. 30, 2021, 16 pages.

* cited by examiner

METHOD AND APPARATUS FOR CLEANING LAUNDRY

TECHNICAL FIELD

The present invention concerns the field of laundry washing machines and fabric cleaning techniques, and particularly to machines and techniques using unit dose packages for detergent or other compositions.

BACKGROUND

The use of automated laundry washing machines is widespread. Such machines include both relatively simple laundry washing machines that can only wash and rinse laundry, and more complex laundry washing machines that can also dry laundry. The term "laundry washing machine" is used herein to refer to both types of laundry washing machine, and other laundry washing machines as may be known or later made available.

Laundry washing machines typically use a liquid solution to help remove soil from fabrics. The liquid solution usually is water-based, and may comprise water alone, or water mixed with additives (e.g., detergent, fabric softener, bleach, etc.). The cleaning solution may be provided at a variety of different temperatures.

A laundry washing machine typically includes a tub configured to receive and hold the cleaning solution and a drum rotatably mounted inside the tub to receive and hold fabric laundry products, such as clothing, bed sheets and other linens, curtains, and the like. The drum is perforated or otherwise configured to allow cleaning solution to pass between the tub and the drum. In "front-loading" washing machines, the drum rotates on a horizontal or nearly horizontal axis, and the cleaning solution is provided in the lower end of the tub, and as the drum rotates, the laundry is repeatedly raised and lowered into and out of the cleaning solution. In "top-loading" washing machines, the drum rotates on a vertical or nearly vertical axis, and the cleaning solution is provided, during the wash phase, at a level at which the laundry is immersed within the solution. The drum may be reciprocated back and forth to agitate the laundry and cleaning solution, or the drum may remain still while a separate agitator located inside the drum moves to perform the agitation.

The laundry washing machine may have a number of operation programs, which may be selected by the user or selected automatically based on detected conditions (e.g., load weight). In a typical wash phase, the laundry washing machine may determine the amount of wash water and rinse water according to a user's selection of a particular washing program, and then proceed to supply the appropriate amount of cleaning solution to the tub, operate the drum, and otherwise control the laundry washing machine components to execute the selected washing program.

Laundry washing machine additives may be provided in various forms, such as loose detergent in powder, liquid or gel form. It is also known to provide additives in the form of a unit dose package (also known as a "UDP" or "pod"). The UDP typically comprises a pre-measured amount of treating agent, such as detergent, incorporated into a water-soluble pouch. The detergent may be, for example powder, liquid, paste, waxy or gel compositions, and the pouch typically comprises a water-soluble film. In some cases, the pouch may have multiple compartments containing different compositions. Suitable pouch materials can vary, but they typically comprise polymeric materials, copolymers, or mixtures of materials.

UDPs can be inserted directly into the laundry washing machine drum with the laundry load. However, the Applicants have found that UDPs provided in this way can suffer from various drawbacks.

One drawback is that the UDP might be dissolved only partially. For example, the UDP can become trapped within the laundry in a way that it is only partially-dissolved, which can lead to incomplete or inefficient cleaning and the formation of spots or stains on the laundry. The UDP also can become trapped in or on the bellows seal that surrounds the drum door, again leading to incomplete or inefficient cleaning. The Applicants have also found that pieces of undissolved UDP pouches often remain in the laundry or in the bellows.

A further drawback that the Applicants have identified is that the UDP can be loaded into the drum and dissolved to release the active ingredients before the washing cycle effectively begins. For example, a UDP may be loaded into the drum and begin dissolving in water present within the drum or in the clothing being cleaned. Then, if the washing cycle starts with a draining phase, which is typically performed for safety and/or hygienic reasons at the very beginning of the cycle, some of all of the active ingredients of the UDP may be flushed away during the initial draining phase.

Another drawback can occur if the washing cycle begins after a delay following insertion of the UDP. In such cases, the UDP may break down or its pouch may dissolve before the washing cycle begins, resulting on undesired spots or stains on the laundry due to contact of the highly concentrated detergent emitted from the UDP with the load of laundry. When this happens, the detergent also may fall to the bottom of the drum and be washed away during an initial draining cycle.

Still another drawback the Applicants have identified is that the effective time of breakage of the UDP and the release of detergent cannot be accurately predicted. Thus, the cleaning cycle cannot be optimized to provide the desired duration of contact between the detergent and the laundry.

The Applicants have developed alternative laundry washing machines that address these drawbacks. For example, the Applicants have provided a laundry washing machine that is configured to receive a UDP in a multipurpose additive dispenser compartment (i.e., within a dispenser drawer with compartments that receives detergent and other additives) having adjacent water inlets that are configured to shape the incoming liquid as a jet that can wet and pierce the UDP's water-soluble outer pouch. In this device, the UDP may be conveniently loaded into a compartment in a dispenser that can alternatively receive loose powdered detergent for the main wash phase, and the water jets break open the UDP while it is still in the drawer compartment. This provides more predictable dissolution of the detergent and the opportunity for improved cleaning. While such configurations have been successful and effective, the Applicants have determined that they have possible shortcomings. For example, the water jets that are supposed to break open the UDP pouch may be located in a fluid line having an air break that prevents reverse flow and siphoning, and this air break can limit the amount of hydraulic pressure available to create an effective water jet. In other cases, no air break may be in the water line, but the water pressure provided at the installation location may be insufficient to provide a water jet that can reliably break open different UDPs.

As another example, the Applicants have provided a system in which the UDP can be flushed from a multipurpose additive drawer to a sump located below the tub, where the UDP's contents mix with the water to provide a more dilute and uniform cleaning solution before being deposited on the laundry. This does not rely on the UDP being actively broken apart be water jets in the drawer, but instead relies on conventional dissolution of the UDP's water-soluble outer membrane. However, the Applicants have determined that relying on such dissolution can have shortcomings. For example, different UDP compositions may take different amounts of time to passively dissolve, and the overall time of the wash cycle may need to be increased to accommodate such passive dissolution to ensure complete mixing of the detergent.

As a result of the Applicant's study of its earlier works, the Applicant has determined that there is a need to provide alternative configurations for laundry washing machine UDP loading and processing systems.

This description of the background is provided to assist with an understanding of the following explanations of exemplary embodiments, and is not an admission that any or all of this background information is necessarily prior art.

SUMMARY

In one exemplary aspect, there is provided a laundry washing machine having: a casing, a washing tub located within the casing, a drum mounted within the washing tub and configured to rotate relative to the casing, a door attached to the casing and being openable to provide access to the drum, an additive loading and supply system configured to receive loose detergent, one or more valves configured to selectively provide water to the additive loading and supply system, a tub supply pipe fluidly connecting the additive loading and supply system to the drum, a receptacle configured to receive a unit dose package comprising a water soluble pouch containing a dose of cleaning product, and means for breaking the unit dose package outside the additive loading and supply system.

The receptacle may be located in the additive loading and supply system, and at least a first portion of the tub supply pipe may be configured to pass an unbroken unit dose package therethrough. In this case, the means for breaking the unit dose package may include a retainer located in the tub supply pipe, the retainer being configured to prevent an unbroken unit dose package from passing downstream through the tub supply pipe. The means for breaking the unit dose package may include one or more nozzles located adjacent to the retainer and configured to deposit water towards the retainer. The means for breaking the unit dose package may include one or more knives or pins operatively associated with the retainer. The one or more knives or pins may be movable to a position in which the one or more knives or pins contact the unit dose package retained by the retainer. The retainer may include a receptacle configured to hold the unit dose package and a quantity of water therein, and the means for breaking the unit dose package further may include one or more nozzles configured to deposit water directly into the retainer. The tub supply pipe may include a vertical shaft portion and the retainer may be located in the vertical shaft portion, and the means for breaking the unit dose package may include water passing from the one or more valves and down the vertical shaft portion.

The means for breaking the unit dose package may include one or more inwards protrusions extending from an inner wall of the washing tub towards the drum and/or one or more outwards protrusions extending from an outer wall of the drum towards the washing tub.

The means for breaking the unit dose package may include one or more nozzles located in the tub supply pipe and configured to direct water directly into the tub supply pipe to break the unit dose package within the tub supply pipe.

The means for breaking the unit dose package may include a recirculation pump fluidly connected to the washing tub and configured to pump water from the washing tub and then back into the washing tub.

The washing tub may include a sump at a lower end thereof, and the means for breaking the unit dose package may include a mixer located in the sump.

The receptacle may be located remotely from the additive loading and supply system. The laundry washing machine further may include one or more nozzles configured to deposit water directly into the receptacle. The receptacle may be located in the door. The receptacle may include a drawer that intersects the tub supply pipe.

BRIEF DESCRIPTION OF THE DRAWINGS

Embodiments of the invention will now be described, strictly by way of example, with reference to the accompanying drawings, in which.

DESCRIPTION OF EXEMPLARY EMBODIMENTS

The exemplary embodiments described herein provide apparatus and methods for introducing UDPs into laundry washing machines. The exemplary embodiments are expected to provide advancements in one or more of efficiency, convenience, cleaning effectiveness, or other performance aspects for laundry washing machines, but the invention is not intended to be limited to any particular performance benchmark requirements.

Exemplary embodiments are described in the context of certain laundry washing machines, as described below. It will be understood that the laundry machines, may be regular washing machines or combined washing-drying machines. However, it will be understood that embodiments of the inventions are not limited to the particular structures or features of the described laundry washing machines, and that embodiments of the inventions may be conveniently applied to other types of laundry cleaning equipment. Such modifications will be understood by persons of ordinary skill in the art in view of the teachings provided herein.

Figure 1:
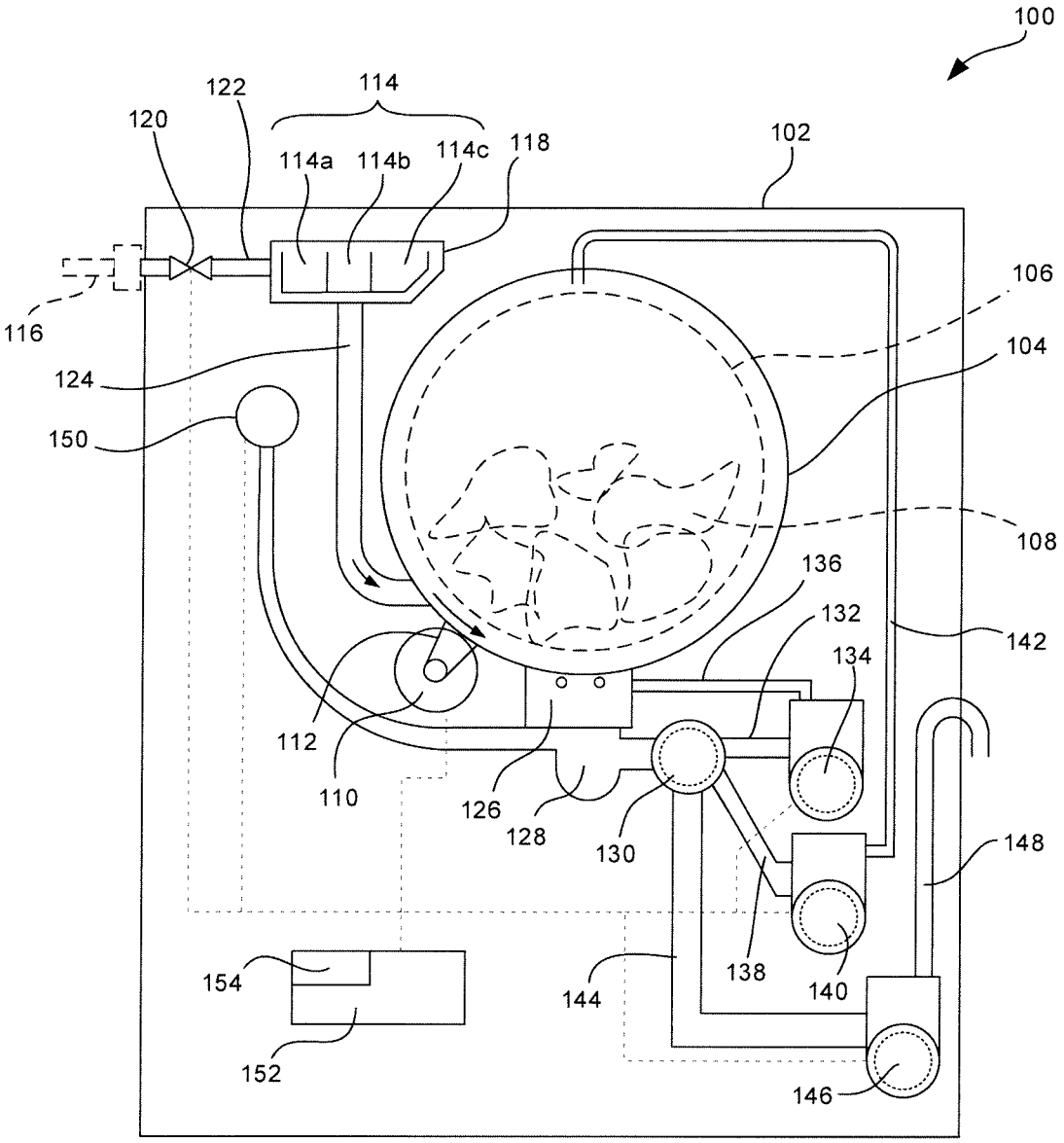
FIG. 1 is a schematic illustration of a laundry washing machine.
Figure 3:
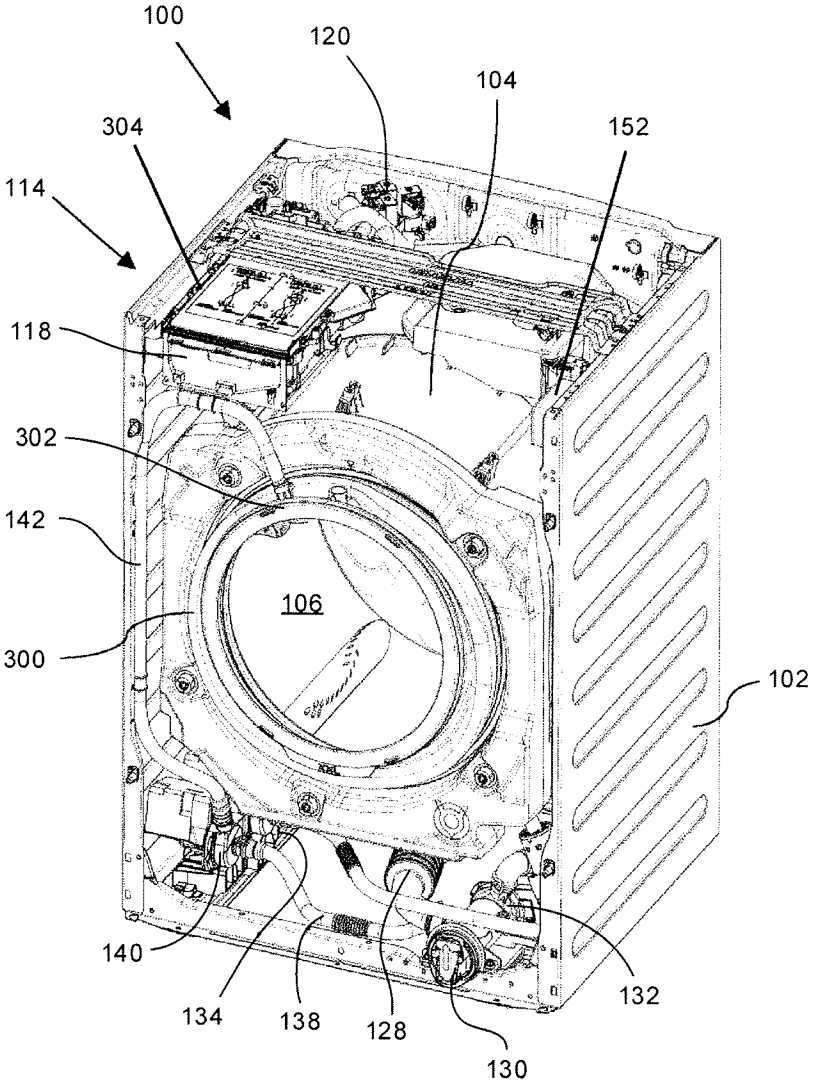
FIG. 3 is an isometric view of the laundry washing machine of FIG. 2, shown with the door, top and front panels removed to illustrate interior components.
Figure 2:
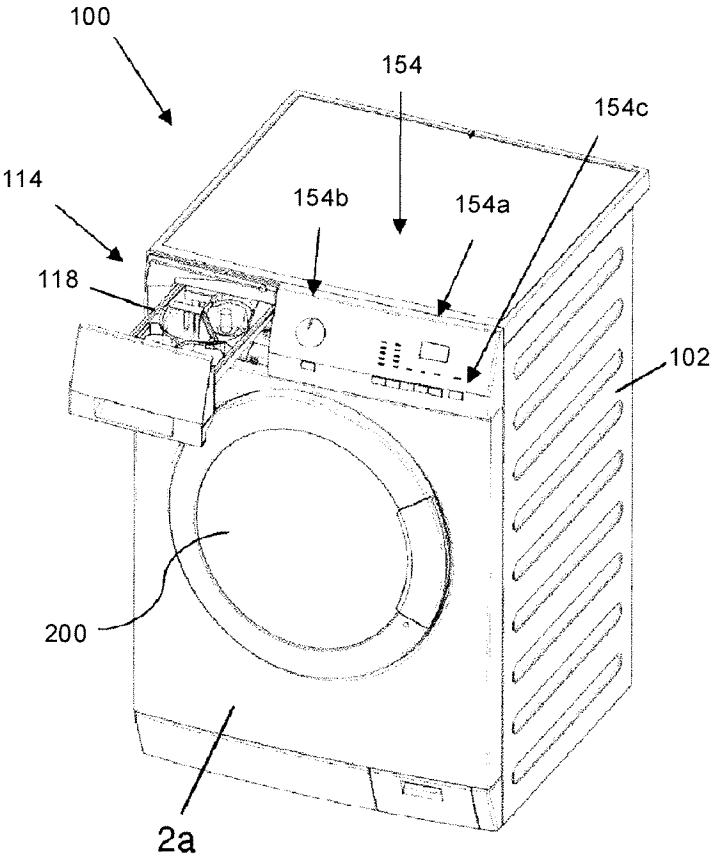
FIG. 2 is an isometric view of an exemplary laundry washing machine.
Figure 4:
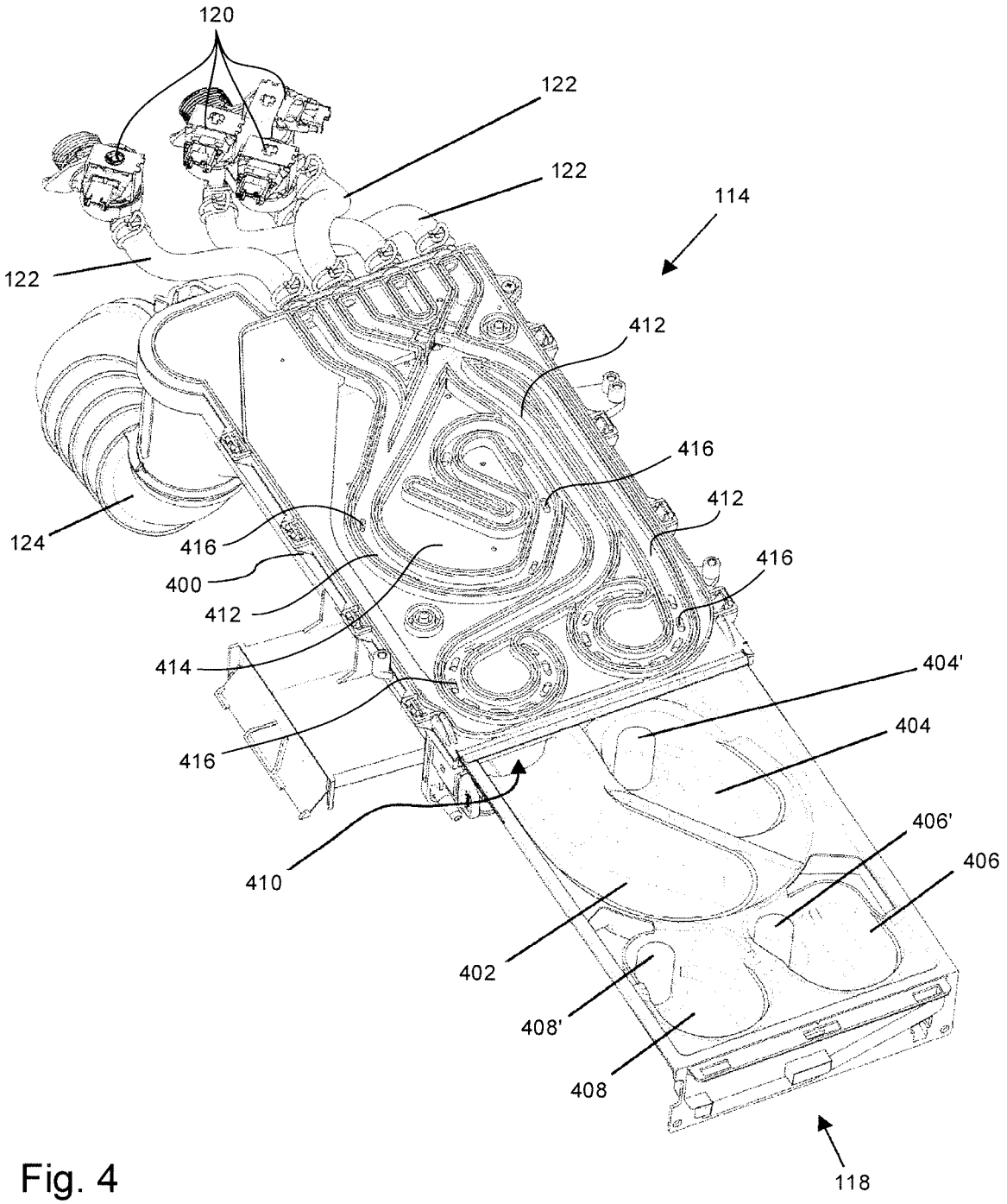
FIG. 4 is an isometric view of a treating agents dispenser of the laundry washing machine of FIG. 2, with a movable drawer in the opened position and a cover of the water distributor removed to view the fluid ducts therein.

FIG. 1 schematically illustrates a laundry washing machine 100 of the front loading variety. FIGS. 2 through 4 illustrate details of the embodiment of FIG. 1, as discussed in more detail below. The laundry washing machine 100 has an external housing or casing 102, in which a washing tub 104 is provided. The washing tub 104 contains a rotatable perforated drum 106 in which laundry 108 to be washed can be loaded. The washing tub 104 and the drum 106 both preferably have a generally cylindrical shape, and the drum 106 may include various internally-projecting or externally-projecting agitators or wash-enhancing structures, as known in the art. The casing 102 includes a door 200 (FIG. 2) that allows access to the drum 106 for loading and unloading laundry 108. A bellows 300 (FIG. 3) is provided around an open end of the tub 104 and drum 106 to form a water-tight seal with the casing 102 and the door 200, when the door 200 is closed, as known in the art. The washing tub 104 is preferably suspended in a floating manner inside the casing 102, such as by a number of springs and shock-absorbers (not illustrated). The drum 106 may be rotated by an electric motor 110 that is operatively connected to the drum 106 by a belt and pulley system 112 or other power transmission mechanisms (e.g., gears, chains, etc.). In some cases, the motor 110 can be directly connected to the drum 106 by a common shaft.

The laundry washing machine 100 includes an additive loading and supply system 114 that is connectable to a water supply system 116, such as household hot and cold water taps. The additive loading and supply system 114 and water supply system 116 preferably are in the upper part of the laundry washing machine 100, but other locations are possible. The additive loading and supply system 114 and water supply system 116 are structured to supply water and washing/rinsing products into the washing tub 104. Such cleaning products, as they are generically called, may include, for example, detergents, stain treatments, rinse additives, fabric softeners or fabric conditioners, waterproofing agents, fabric enhancers, rinse sanitization additives, chlorine-based additives, bleach, etc.

The additive loading and supply system 114 may include a dispenser tray with one or more compartments designed to be filled or loaded with washing and/or rinsing products. Such compartments may include, for example, a main wash detergent compartment 114*a*, a stain treatment detergent compartment 114*b*, a bleach compartment 114*c*, and a fabric softener compartment 114*d*. The main wash detergent compartment 114*a* may be configured to receive powdered detergent and/or detergent contained in a dissolvable UDP. A liquid detergent cup may be provided that is adapted to be received in the main wash detergent compartment for loading and dispensing liquid detergent for the main wash phase. It will be appreciated that there may be more or fewer compartments in the additive loading and supply system 114 as may be appropriate for the desired feature level of the washer and in the market in which the washer will be sold.

The dispenser tray containing the compartments may be integrated into a movable drawer 118 or a removable container. For example, the additive loading and supply system 114 may comprise a sliding drawer having separate compartments for detergent, bleach and softener. Such a slidable drawer 118 is shown in the opened position in FIG. 2, and in the closed position in FIG. 3. Alternatively, the additive loading and supply system 114 may comprise one or more compartments that are fixed in place within the casing 102, and the casing 102 may include an openable door in the front of the washer or an openable lid in the top of the washer through the case 102. The additive loading and supply system 114 may also be located behind the door in a front load washer or under the lid in a top load washer. In such embodiments, the user can load detergent and the like into the additive loading and supply system 114 through the opened door.

The additive loading and supply system 114 also may be connected to one or more controllable supply valves 120 by one or more main inlet pipes 122 (it will be understood that the term "pipe" includes rigid pipes, flexible hoses, open channels, and any other structure configured to convey liquid from one location to another). The supply valves 120 are selectively operable to provide hot and/or cold water to one or more of the compartments. Where multiple compartments are used, the supply valves 120 may be operated separately or simultaneously to dispense fluid into and through each compartment, either individually or in one or more groups, as known in the art, in order to dispense each washing/rinsing product into the washing tub 104 at the appropriate time in the wash cycle. As the water provided by the water supply system 116 passes through the compartments, it combines with the contents of the compartments, thus forming a liquid cleaning solution.

The water supply system 116 is connected to the washing tub 104 by one or more tub supply pipes 124. For example, the tub supply pipe 124 may comprise a passage that terminates at a lateral side or lower portion of the tub 104, as shown in the example of FIG. 1. Alternatively the tub supply pipe 124 may connect to the bellows 300 or seal that connects the opening of the tub 104 to the casing 102. The tub supply pipe 124 also may connect to the washing tub 104 by way of the drum 106—e.g., by being connected to a bellows that feeds directly into the drum 106, and thus also fluidly communicates with the washing tub 104 via holes in the drum 106. As another alternative, the supply pipe 124 may connect to a reservoir, where the incoming liquid solution accumulates and may be heated or agitated before being pumped via a separate pump to the tub 104. In any case, the liquid solution may enter the tub 104 directly (e.g., enter through an outer wall of the tub 104), or indirectly (e.g., enter the tub 104 by way of the drum 106 or a reservoir). Other alternatives and variations will be apparent to persons of ordinary skill in the art in view of the present disclosure.

The composition of the liquid solution passing through the tub supply pipe 124 preferably can selectively contain one of the products contained in the compartments of the drawer 118, or such liquid solution can be clean water (i.e., water without added products), depending on the phase of the washing program and user preferences. For example, in the initial phases of the main washing phase of a wash cycle, a liquid detergent solution may be conveyed from the main wash detergent compartment 114*a* into the tub 104 by the incoming water, while in other phases, such as during a rinsing phase, only water is conveyed into the tub 104.

In an optional aspect of the present invention, a sump 126 may be provided at the bottom of the tub 104, to provide, among other things, a reservoir in which water and one or more products from the drawer compartments can be thoroughly dissolved, mixed and evenly dispersed (homogenized) in the water prior to being deposited on the laundry 108 in the drum 106. The wash liquid in the sump may also be heated to a sufficient temperature to fully activate the detergent prior to being deposited on the laundry 108 in the drum 106 for enhanced cleaning effectiveness. The volume of the sump 126 may be selected to completely hold an initial charge of the incoming wash liquid solution. The initial charge of water maybe of a quantity sufficient fill the drum 106 to a level at which wash solution is below the drum 106 and does not wet the laundry on the drum.

In the shown embodiment, the sump 126 is fluidly connected to a main outlet pipe 128, which leads to a filter 130. The filter 130 (which is optional), is provided to filter debris that might be harmful to the downstream pump or pumps from the liquid solution. Any suitable filter type may be used (e.g., paper, plastic or metal mesh, etc.). The outlet of the filter 130 may be connected to a first pipe 132 that leads to the inlet of a recirculation pump 134. The outlet of the recirculation pump 134 is connected to a recirculation pump outlet pipe 136 that leads back to the sump 126. Upon activation, the recirculation pump 134 draws liquid solution out of the sump 126 and then pumps it back into the sump 126, to thereby fully dissolve the detergent, and mix and homogenize the wash solution. A heater may also be provided in the sump (or other suitable location in the recirculation path) to assist with the process of activating the detergent or other active ingredients in the liquid solution.

The outlet of the filter 130 is also connected to a second pipe 138, which leads to the inlet of a distribution pump 140. The outlet of the distribution pump 140 is connected a distribution pump outlet pipe 142 that leads to the tub 104. Once the detergent has been substantially fully dissolved, homogenized and activated in the wash liquid in the sump, the distribution pump 140 is activated to convey the liquid solution from the sump 126 to an upper region of the drum 106, where the liquid solution is applied to the laundry 108 as the drum is rotated to wet the laundry with the wash liquid. The distribution pump outlet pipe 142 preferably is positioned to effectively distribute the liquid solution throughout the laundry 108. For example, it may lead to a tub inlet 302 located on an upper portion the bellows seal 300 surrounding the drum closure door 200, or the like, and there may be a spray nozzle on the outlet to spray the wash liquid on the laundry. An additional charge of water is supplied to the drum to raise the level of the wash liquid into the lower portion of the drum, such that as the drum is rotated the laundry is lifted by vanes in the drum out of the wash liquid and dropped back into the wash liquid.

The outlet of the filter 130 is also connected to a water draining system that is configured to drain the liquid solution, e.g., dirty water or water mixed with cleaning products and dirt, from the tub 104 and drum 106. For example, the water draining system may include a third pipe 144 that connects the outlet of the filter 130 to the inlet of a draining pump 146. The outlet of the draining pump 146 is fluidly connected to a main outlet pipe 148. Upon activation, the draining pump 146 conveys liquid solution from the sump 126 to the main outlet pipe 148. The main outlet pipe 148 is configured to be fluidly connected to a household draining pipe system (not illustrated).

The first pipe 132, second pipe 138 and third pipe 144 are shown as being fluidly separate from one another, but it will be appreciated that they may be fluidly connected as branches of a common fluid passage. It will also be appreciated that each of the pumps 134, 140, 146 may have its own separate filter or one or more may not have a filter. Also, the main outlet pipe 128 may be directly connected to the draining pump 144, rather than passing through the filter.

In other embodiments, one or both of the recirculation pump 134 and the distribution pump 140 (as well as the associated fluid paths) may be omitted. For example, both pump 134, 140 may be omitted, and the tub supply pipe 124 may lead directly to a drum inlet 302 located at the top of the bellows door seal 300. As another example, the recirculation pump 134 may be omitted, but the distribution pump 140 may remain to pump the detergent from the sump 126 to the top of the drum 106. Other alternatives and variations will be apparent to persons of ordinary skill in the art in view of the present disclosure.

The laundry washing machine 100 may be advantageously provided with one or more liquid level sensors 150 (schematically illustrated in FIG. 1) configured to sense or detect the liquid level inside the tub 104 as is well understood in the art. The level sensor 150 may comprise, for example, a pressure sensor that is acted upon by the liquid in the tub 104 to provide a sensor signal indicative of the liquid level of the wash water and/or the foam level contained in the tub 104. In some cases, the pressure sensor may be fluidly connected with a draining sump of the water draining system. The level sensor 150 also may comprise a mechanical, electro-mechanical, electrical, or optical fluid level measuring system, etc. Such devices are known in the art (e.g., floats, capacitance sensors, etc.) and need not be described in detail herein.

The laundry washing machine 100 also includes a control unit 152. The control unit 152 includes hardware and software configured to operate the laundry washing machine. In one example, the control unit 152 includes one or more processors that are programmed to execute machine-readable code stored on one or more memory devices. A typical processor may be a central processing unit (CPU), a microprocessor, an application-specific integrated circuit (ASIC), and so on. Memory devices may be provided as random access memory (RAM) for temporary data storage, read only memory (ROM) for permanent data storage, firmware, flash memory, external and internal hard-disk drives, and the like. The processor communicates with the memory device via a communication bus or the like to read and execute computer-readable instructions and code stored in a non-transient manner in the memory devices. The incorporation of control units into laundry washing machines is well-known in the art and the details of the control unit 152 need not be explained in more detail herein.

The control unit 152 is operatively connected to the various parts of the laundry washing machine 100 in order to control its operation. The control unit 152 preferably is operatively connected to: the electric motor 110 so that the drum speed may be controlled; the controlled supply valves 120 so that the water supplied to the drawer 118 is controlled; and to the pumps 134, 140, 146 to control their respective operations. The control unit also may be connected to the level sensor 150 to determine a level of water and/or foam inside the tub 104, a load weight measuring system, one or more water temperature sensors, lockout switches (e.g., a switch that prevents operation if the loading/unloading door 200 is opened), and so on. The control unit 152 also may be configured to perform unbalanced laundry checks to verify whether the laundry 108 loaded in the drum 106 is balanced or not, and to perform various conventional operations.

The operative connections between the control unit 152 and the remaining parts (shown schematically by dashed lines) may be by electrical wires, wireless communication, and the like. Suitable control devices (e.g., solenoids to operate valves, motor controllers, etc.) are provided to allow the control unit 152 to operate the various components. Conventional fuses, power converters, and other ancillary features also may be included as necessary or desired.

The control unit 152 is also operatively connected to a user interface 154 that is accessible to the user. The user interface 154 is configured to allow the user to select and set the washing parameters, for example by selecting a desired washing program. The user interface 154 also may be configured to allow the user to input other operating parameters, such as the washing temperature, the spinning speed, the load in terms of weight of the laundry to be washed, the type of fabric of the load, etc.

The user interface 154 may comprise any suitable arrangement of input and output mechanisms. For example, input may be provided by one or more dials, switches, buttons, touchscreens, or the like, and output may be provided by one or more position markers, textual or graphic images, illuminable lights or displays, touchscreens, and so on. In one example, the user interface includes a display 154*a*, power button, a rotatable operation program selection dial 154*b* that selects among pre-set operation programs (e.g., sanitary cycle, light load, heavy load, etc.), and a number of operation program adjustment buttons that can be operated to modify aspects of the pre-set operation programs (e.g., temperature adjustment, time adjustment, spin speed adjustment, etc.). One input may comprise a dedicated UDP or Pod cycle input 154*c* button or selector.

The control unit 152 is configured to operate the various parts of the laundry washing machine 100 to effectuate the pre-set operation programs, and to make adjustments to these operation programs based on user input. The control unit 152 also may use sensor feedback to modify the cycles and variables for each pre-set operation program. For example, the control unit 152 may change the volume of water used during a particular load cycle based on detecting a load weight above a certain value. As another example, the control unit 152 may reduce the spin speed of a particular spin cycle if a balance indicator (e.g., an accelerometer or the like) indicates excessive vibration. Other alternatives and variations will be apparent to persons of ordinary skill in the art in view of the present disclosure.

FIG. 4 illustrates features of the additive loading and supply system (or additive supply system) 114 and related components, including the valves 120, main inlet pipes 122, drawer 118, and tub supply pipe 124. The additive loading and supply system 114 includes the drawer 118, which is slidingly received within a drawer housing 400. The exemplary drawer 118 includes a main wash compartment 402, and may include additional compartments, such as a second compartment 404, a third compartment 406, and a fourth compartment 408, as previously described.

The first or main wash compartment 402 is configured to receive powdered detergent, liquid detergent with the insertion of an inset cup, or detergent provided in a UDP form for the main wash phase of a wash cycle. In particular, the main wash compartment 402 is sized to receive UDPs having one or more shapes and sizes. The main wash compartment 402 has an open rear end to allow powder detergent or the UDP to move out of the main wash compartment 402, through a funnel, into the supply pipe 124 and to the tub. The main wash compartment may be in the form of a trough (e.g. gutter) formed in the bottom internal wall of the drawer housing 400 that slopes downward to the funnel/tub supply pipe 124 located adjacent the rear end of the bottom wall.

The additional compartments 404, 406, 408 are configured to receive liquid additives (e.g., liquid detergent, fabric softener, fabric conditioners, waterproofing agents, fabric enhancers, rinse sanitization additives, chlorine-based additives, bleach, etc.). Each additional compartment has a respective siphon tube 404', 406', 408' that empties into the space between the bottom internal wall of the drawer housing and a lower external wall of the drawer housing. The external lower wall slopes downward toward a read end of the drawer housing and the lower outer wall, to allow liquid additives to move out of the drawer housing, through the funnel and the supply pipe 124, and into the tub. The funnel for the liquid additives may be the same as the one provided for the dry detergent, but separate funnels may be used if desired.

Dry detergent, UDPs and liquid additives are moved from their respective compartments to the tub supply pipe 124 by activating the appropriate valves 120 to create water flows to move the additives. In the illustrated example, the valves 120 are fluidly connected to a plurality of fluid ducts 412 located in the upper wall 414 of the drawer housing 400. The ducts 412 include respective outlet ports 416 that direct incoming hot and/or cold water to one or more of the compartments. The outlet ports 416 may have any desired configurations and positions. The ducts 412 are shown for clarity in FIG. 3 as being open to the top, but in normal use they preferably are sealed from above by a cover 304 (FIG. 3) to prevent leakage.

Selective operation of the valves 120 can be implemented to direct fluid to the desired compartment at the desired time, as known in the art. Water directed to the main wash detergent compartment 402 causes the main wash detergent or UDP to move through the outlet 410 and into the tub supply pipe 124. To this end, the bottom wall of the main wash compartment 402 may be sloped downwards towards the outlet 410. Such slope may be selected such that powdered detergent or a UDP does not move through the outlet 410 until water is provided into the main wash compartment. In those cases in which a liquid detergent is desired to be added to the compartment, a removable cup having a siphon (not shown) may be provided to hold the liquid detergent and prevent it from flowing through the outlet 410. Water directed to the liquid additive compartments 404, 406, 410 (or to compartment 402 when a liquid cup is used) accumulates in those compartments until the liquid level is high enough to enter the respective siphon 404', 406', 408', resulting in ejection of the liquid through the siphon 404', 406', 408'.

As noted above, it is known from the Applicant's prior work to configure a compartment such as the main wash compartment 402 to have features for actively breaking open a UDP. For example, one or more of the outlets 416 may be configured to generate water jets that penetrate the UDP's outer pouch. It is also known from the Applicant's prior work that a UDP that is not actively broken open (either by a failure of the water jets or simply an absence of the water jets from the device) may progress to a sump 126 where it is opened by conventional dissolution of the water-soluble outer pouch. While those configurations and machine functionalities are both useful (and may be used with embodiments of the present invention), other alternatives are believed to be useful. The following embodiments described herein preferably are configured to provide active UDP breaking (as opposed to simply passive dissolution in a bath of liquid) at a location other than within a multipurpose additive compartment (e.g., drawer 118).

Figure 5:
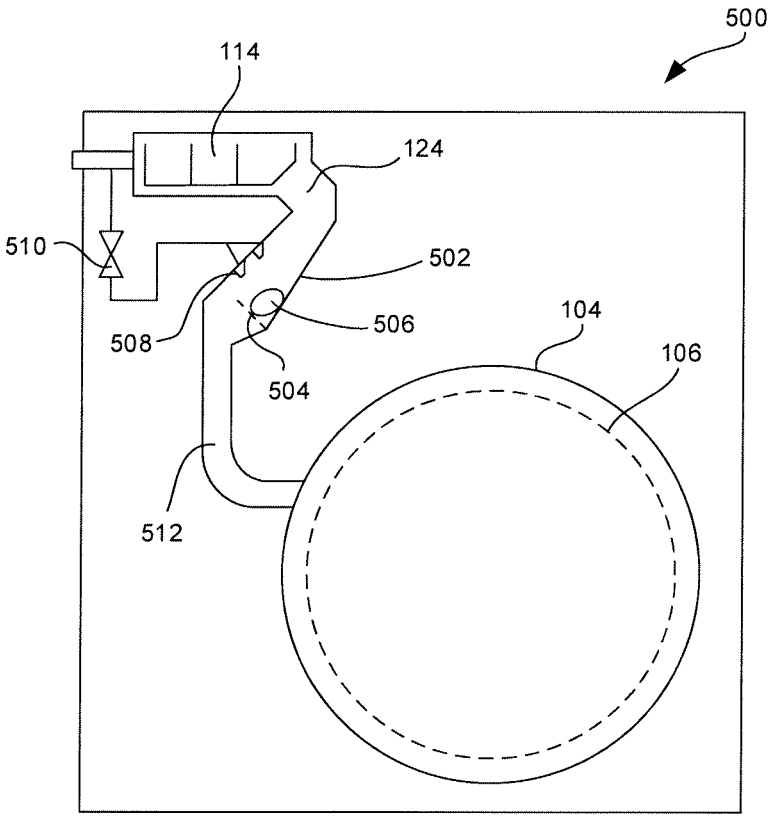
FIG. 5 is a schematic illustration of another embodiment of a washing machine.

Referring now to FIG. 5, in one embodiment, a laundry washing machine 500 may be configured with a UDP breaking chamber 502 located in the hydraulic line between an additive loading and supply system 114 and a tub 104. In this embodiment, the additive loading and supply system is configured to receive the UDP, and may have a construction similar to the one shown in FIG. 4, in which it is also configured to receive powdered detergent, fabric softener, bleach, and the like. The additive loading and supply system 114 is connected to the UDP breaking chamber 502 by a first tub supply pipe 124, which is dimensioned and shaped to allow a UDP having a conventional shape and size to pass from the additive loading and supply system 114 to the UDP breaking chamber 502. To this end, the first tub supply pipe 124 may have a cross-sectional area and cross-sectional shape selected to accommodate conventional UDP products. It will be understood by persons of ordinary skill in the art that various UDP products are provided having somewhat different shapes and sizes, but such products generally fall within a concise and well-understood range of dimensions. The additive loading and supply system 114 is also configured to provide a controllable flow of water to flush the UDP down the first tub supply pipe 124. Conventional water distribution hoses and the like may be used for this purpose.

The UDP breaking chamber 502 (which may be a separate discrete chamber or simply a portion of the first tub supply pipe 124) includes a retainer 504 that is configured to hold the UDP 506 during the breaking process. The retainer 504 may comprise, for example a perforated plate, a wire mesh, one or more rods or ribs that extend into or pass through the chamber 502, and so on. The retainer 504 also may comprise a restriction in the cross-sectional shape or size of the UDP breaking chamber 502. For example, the first tub supply pipe 124 may transition abruptly or funnel down to a smaller dimension at the beginning of a second tub supply pipe 512, such that the UDP is no longer able to pass further until it becomes at least partially dissolved. The retainer 504 also may comprise a movable structure that obstructs (i.e., closes or partially closes) the hydraulic path from the additive loading and supply system 114 to the washing tub 104, such as a flap, a slide, a door, and so on.

One or more nozzles 508 are provided to direct a flow of water onto the UDP 506 while it is held by the retainer 504. The nozzles 508 preferably are connected to a water valve 510, and preferably are configured to generate a concentrated flow (e.g., a laminar flow jet) of water to help penetrate the UDP pouch. In a preferred embodiment, the valve 510 is a dedicated valve that operates only to pass water to the nozzles 508, and the fluid passage from the valve 510 to the nozzles 508 does not include any air breaks so that the water remains pressurized as it passes into the nozzles 508. However, the valve 510 alternatively may be connected to other outlets (e.g., an outlet configured to flush the UDP down the first tub supply pipe 124), and it is not strictly required to omit an air break in the water line between the valve 510 and the nozzles 508.

In use, the UDP 506 is flushed into the breaking chamber 502 and the valve 510 is activated to generate flows of water through the nozzles 508. The water strikes the UDP 506, and the UDP's pouch eventually partially dissolves and is pierced by the water. At this point, the contents of the UDP 506 begin flushing down the second tub supply pipe 512 that leads from the breaking chamber 502 to the tub 104. The second tub supply pipe 512 may lead directly to the tub 104, or may lead there by way of a sump and other pumps and passages, such as discussed above in relation to FIG. 1. The supply of water through the nozzles 508 also may be coordinated with a supply of water down the first tub supply pipe 124 (e.g., simultaneous or alternating flows), which may be helpful to dissolve the UDP pouch and distribute and flush the UDP's contents down the secondary supply pipe 512.

The laundry washing machine 500 also may include features to help ensure that any undissolved parts of the UDP (e.g., portions of the pouch or clumps of detergent) are flushed out of the breaking chamber 502. For example, the retainer 504 may be dimensioned to be only slightly larger than the UDP, so that once the UDP starts dissolving and losing its shape it is free to pass down the second tub supply pipe 512. As another example, the retainer 504 may be retractable to be flush with the inner wall of the breaking chamber 502 so that it does not impede the movement of any undissolved parts of the UDP. Such a device can operate by solenoid or motor control, by hydraulic pressure (e.g., the retainer 504 retracts or bends over upon being contacted by an inrush of water from the first tub supply pipe 124, or flexes when the UDP becomes saturated with water), and so on. Other alternatives and variations will be apparent to persons of ordinary skill in the art in view of the present disclosure.

Figure 6:
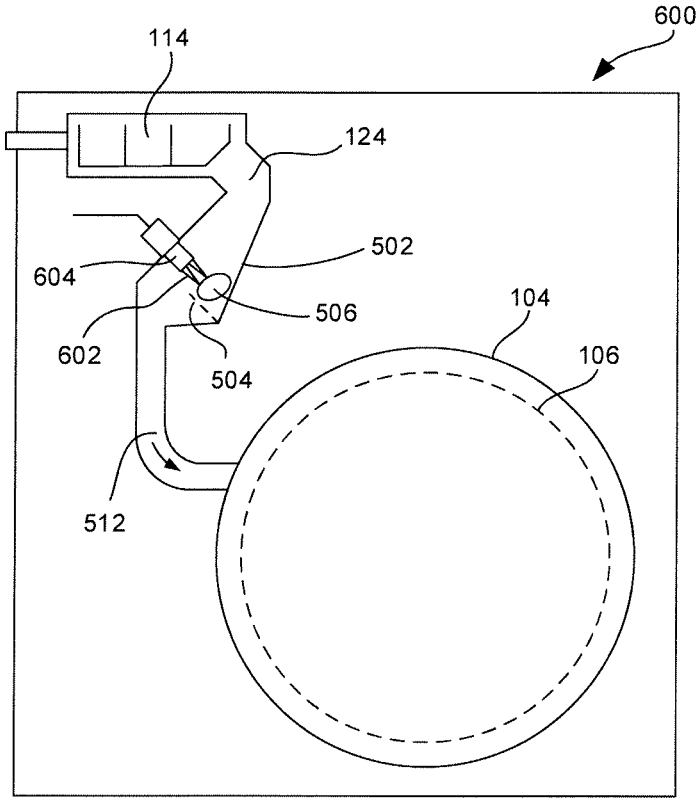
FIG. 6 is a schematic illustration of another embodiment of a washing machine.

FIG. 6 illustrates a laundry washing machine 600, which is a variation on the embodiment of FIG. 5. In this example, the nozzles 508 are replaced by a mechanical means for breaking the UDP pouch. The mechanical breaking means may comprise any solid physical structure that is moved into contact with the UDP 506 to mechanically break open the pouch (as opposed to hydraulic penetration as discussed in relation to FIG. 5). In the illustrated example, the mechanical breaking means comprises one or more knives or pins 602 that are mounted on a movable mount 604. The pins 602 or other mechanism may be configured to merely penetrate the pouch (e.g., leave a pattern of penetrations that facilitate dissolution by water), or it may be configured to physically tear apart the pouch (e.g., cleave the entire pouch into two halves). The movable mount 604 may be controlled by any suitable actuator (e.g., an electric solenoid, hydraulic ram or electric motor), and may have any suitable motion path (e.g., a slider or a rotating arm).

In the embodiment of FIG. 6, the mechanical breaking means may be active or passive. In an active system, the mechanical breaking means operates by physically moving into contact with the UDP 506. This may be accomplished by making the breaking means movable, such as discussed above, or providing a mechanism that moves the UDP 506 into contact with a breaking means that is fixed in place within the breaking chamber 502. In a passive system, the mechanical breaking means may comprise a sharp object that the UDP strikes under the force of gravity or is pressed against under hydraulic pressure of incoming water. For example, the retainer 504 may have spikes or blades extending towards the UDP. Other alternatives and variations will be apparent to persons of ordinary skill in the art in view of the present disclosure.

Figure 7:
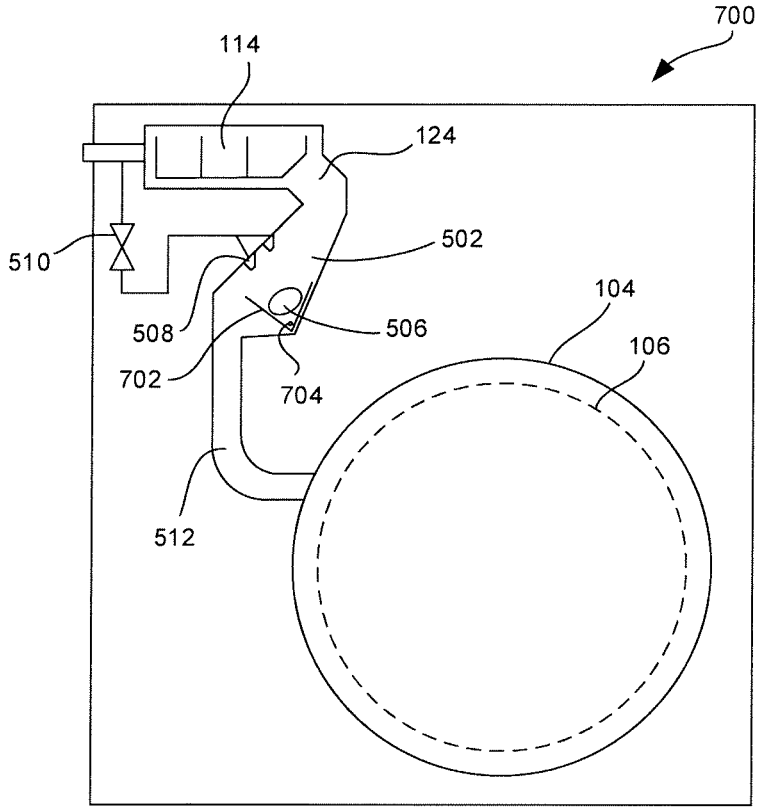
FIG. 7 is a schematic illustration of another embodiment of a washing machine.

FIG. 7 illustrates another embodiment of a laundry washing machine 700. This is also a variation on the embodiment of FIG. 5. In this case, the retainer 504 is a receptacle 702 that is configured to hold both the UDP 506 and a volume of water. For example, the receptacle 702 may be shaped as an open-topped trough or the like. The receptacle 702 may be filled with water by water flowing down the first tub supply pipe 124, by water from the nozzles 508, by a separate water pipe, and so on. The water in the receptacle 702 helps soften and dissolve the UDP pouch, while the nozzles 508 apply a spray of water to hydraulically break the pouch. As shown in FIG. 7 (as well as FIGS. 5 and 6), the tub supply pipe 124 may expand to form a chamber 502 that holds the retainer 504, but this is not strictly required in any embodiment. For example, the retainer 504 may be located in a portion of the tub supply pipe 124 that has a uniform size with (or smaller size than) the remainder of the tub supply pipe 124.

The receptacle 702 may have any suitable size and shape. Preferably, it is large enough to hold a volume of water that partially- or fully-immerses the UDP 506. The shape also may be selected to ensure that the UDP 506 is properly captured as it moves down the first tub supply pipe 154. For example, the receptacle 702 may block the breaking chamber 502 sufficiently that it is not possible for an unbroken UDP 506 to pass to the second tub supply pipe 512.

The receptacle 702 preferably is configured to eventually release the UDP (or the remnants thereof) and the water. For example, the receptacle 702 may be mounted on a pivot 704, and displaced by a mechanism such as a solenoid, electric motor, or hydraulic piston at a predetermined time. The receptacle 702 and the pivot 704 also may be mounted in such a way that it automatically tilts over when the volume of liquid reaches a certain level, at which time the center of mass shifts to cause the receptacle 702 to tilt over.

A receptacle 702 such as described in this embodiment also may be used in conjunction with a mechanical breaking means. For example, the nozzles 508 may be replaced by pins 602 or the like such as described in relation to FIG. 6. As another example, the receptacle 702 may have spikes or knives extending from it, in order to help pierce the UDP pouch as it falls into the receptacle 702. Other alternatives and variations will be apparent to persons of ordinary skill in the art in view of the present disclosure.

Figure 8:
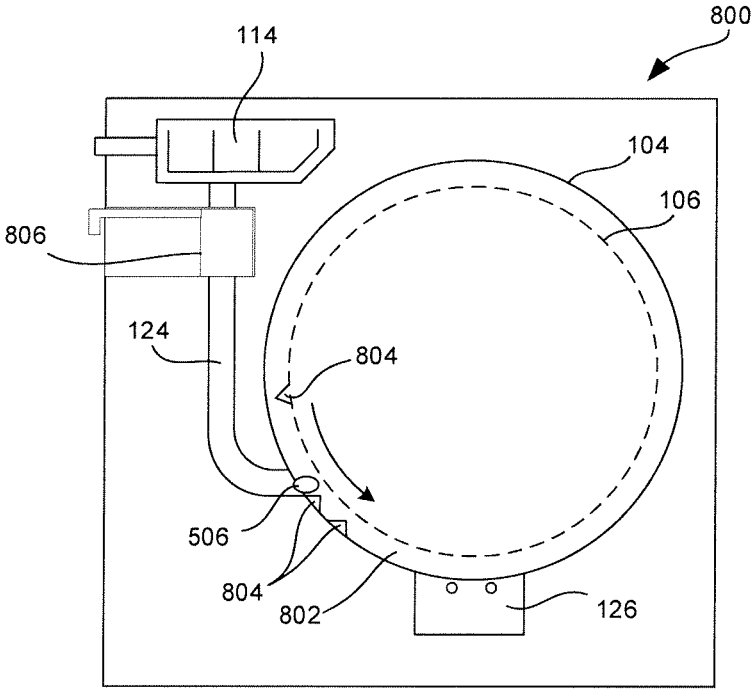
FIG. 8 is a schematic illustration of another embodiment of a washing machine.

FIG. 8 shows another embodiment of a laundry washing machine 800 having a mechanical breaking mechanism. In this case, at least a portion of the space 802 between the inner wall of the tub 104 and the outer wall of the drum 106 comprises a narrow region that is sized to be smaller than the expected size of the UDP 506. As the drum 106 rotates, as shown by the arrow in FIG. 8, the UDP 506 is dragged into the narrow region of the space 802, where the UDP 506 is compressed and torn apart by contact with the tub 104 and drum 106. This narrow portion may be formed by the cylindrical walls of the tub 104 and drum 106, or it may be formed by (or include) one or more protrusions 804. The protrusions 804 may extend from the tub 104 towards the outer wall of the rotatable drum 106 and/or from the drum 106 towards the inner wall of the tub 104. The protrusions may comprise simple bumps, or they may have sharp edges or points that help break the UDP 506 apart. The particular size of the narrow region can vary depending on the expected size of UDPs being used with the machine, and if multiple different types of UDP are used the narrow region preferably is selected to be smaller than the smallest UDP size.

FIG. 8 also shows an example of an auxiliary loading port 806, which also may be used with other embodiments described herein. The auxiliary loading port 806 provides a separate access point for adding a UDP 506 to the laundry washing machine 800. In this example, the auxiliary loading port 806 comprises a sliding drawer receptacle that intersects the tub supply pipe 124 between the additive loading and supply system 114 and the tub 104. The drawer can be opened to receive a UDP 506, then closed to deposit the UDP 506 into the tub supply pipe 124. In another example (not illustrated), the auxiliary loading port 806 may comprise a fixed receptacle that is accessed by an openable door or cover through a side wall or top wall of the machine. Other alternatives and variations will be apparent to persons of ordinary skill in the art in view of the present disclosure.

Figure 9:
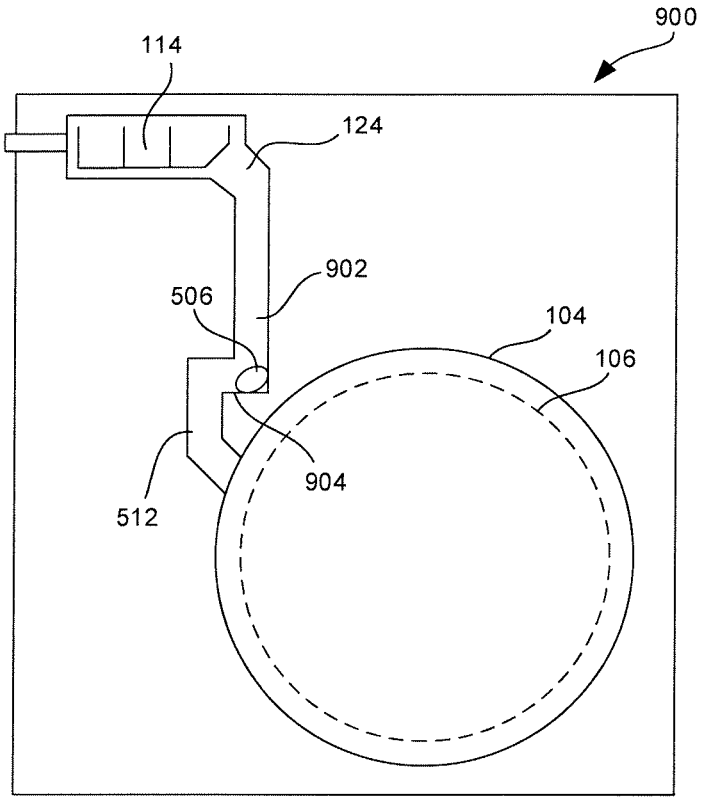
FIG. 9 is a schematic illustration of another embodiment of a washing machine.

FIG. 9 illustrates a further embodiment of a laundry washing machine 900. In this example, a UDP breaking chamber is provided in the form of a vertical shaft 902. The UDP 506 sits on a retainer, such as a shelf 904, at the bottom of the shaft 902, and incoming water falls down to strike the UDP. Thus, gravity is used to accelerate the water to help hydraulically break the UDP pouch. The vertical shaft 902 may be formed by the first tub inlet pipe 124, such as shown in FIG. 9, but this is not strictly required. A retainer (not shown) or mechanical breaking devices (e.g. spikes), such as discussed above, may be provided to hold the UDP 506 at the bottom of the shaft 902 or to help ensure proper breakage thereof. For example, the shelf 904 may be formed with a downward recess that holds the UDP 506 in place, and one or more channels may extend from the recess to the second tub supply pipe 512 to ensure complete drainage of the recess. The vertical shaft 902 may extend only a small distance along the height of the laundry washing machine 900, but more preferably extends along a major portion (e.g. more than half or nearly the entire height) of the laundry washing machine height in order to enhance the water's velocity increase by providing more prolonged gravitational acceleration of the water.

Figure 10:
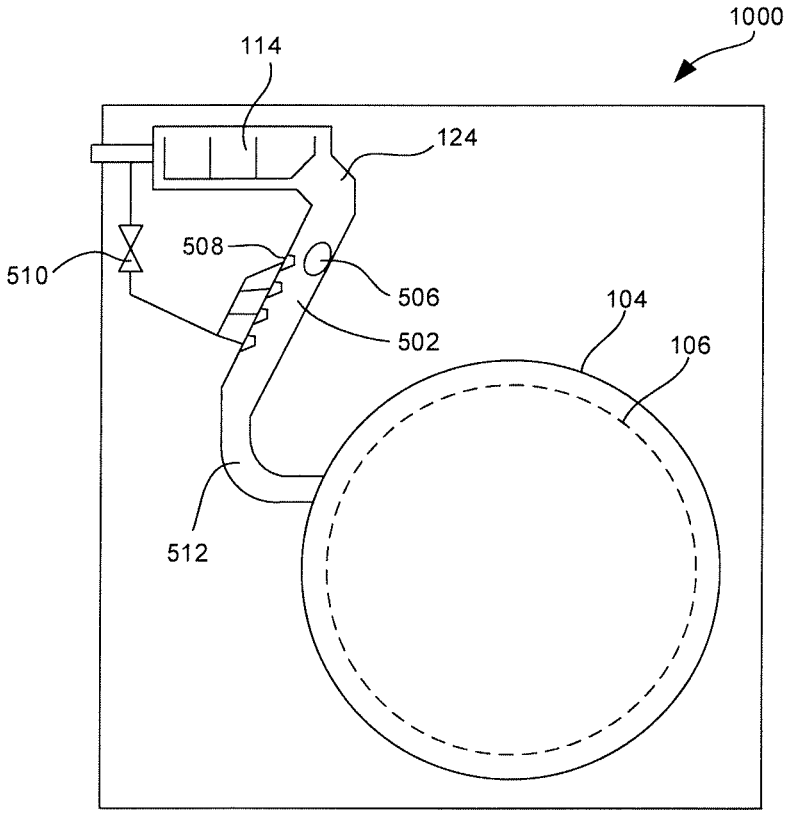
FIG. 10 is a schematic illustration of another embodiment of a washing machine.

FIG. 10 shows yet another embodiment of a laundry washing machine 1000. In this embodiment, the UDP breaking chamber is formed as a chute 1002 that does not have a retainer therein. The UDP 506 is free to move along the chute 1002 without being stopped by contact with a solid object, although friction with the chute's wall is expected to slow the descent of the UDP 506. The chute 1002 includes one or more nozzles 810 such as those described elsewhere herein. The nozzles 810 preferably are configured to direct concentrated jets of water to strike and pierce the UDP pouch. The nozzles 810 also may be directed at an angle (e.g., upwards from horizontal) that impedes or slows the movement of the UDP 506, which may provided additional time for the water to pierce the UDP 506. In other embodiments, mechanical breaking devices, such as moving pins or blades, or a rotating wheel or track, may be provided in the chute 1002 to break the UDP pouch.

Figure 11:
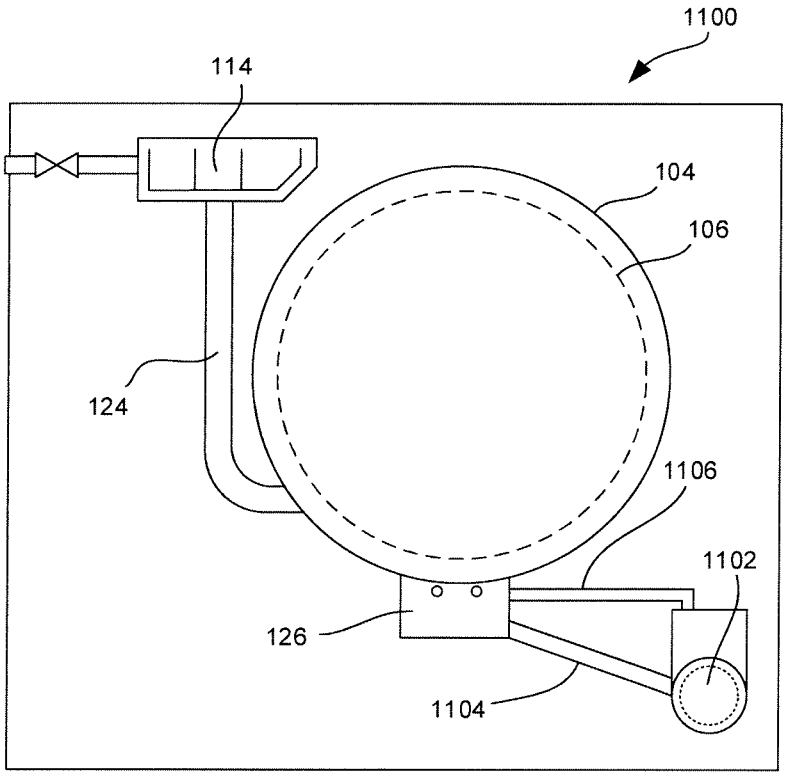
FIG. 11 is a schematic illustration of another embodiment of a washing machine.

FIG. 11 illustrates another embodiment of a laundry washing machine 1100. In this example, the UDP is mechanically broken by a pump 1102. The hydraulic line from the additive loading and supply system 114 to the pump 1102 is sized to allow the UDP to flow all the way to the pump 1102, and the pump 1102 has an open impeller inlet that is sized to receive all or a portion of the UDP. As the UDP enters the impeller inlet, the impeller cuts or tears apart the UDP pouch. In the shown example, the pump 1102 is a recirculation pump that receives the UDP through a pump inlet pipe 1104 located downstream of a sump 126, such as the sump described above. A pump outlet pipe 1106 leads back to the sump 126 to recirculate the water and the contents of the UDP. In other embodiments, the pump 1102 may be fluidly located between the additive loading and supply system 114 and the tub 104, in which case the pump outlet pipe 1106 may feed to the tub 104, the sump 126, or to other parts of the hydraulic line. In still other embodiments, the pump 1102 may be downstream of the tub 104 or sump 126, but have an outlet pipe 1106 that feeds to the tub 104 instead of leading back to the sump 126. Other alternatives and variations will be apparent to persons of ordinary skill in the art in view of the present disclosure.

It is also envisioned that the embodiment of FIG. 11 may be configured such that the UDP cannot pass down the pump inlet line 1104 to the pump 1102. For example, a screen may be placed over the pump inlet line 1104, or the pump inlet line 1104 may be located or sized such that the UDP cannot enter it. In this embodiment, the pump 1102 may be operated to recirculate water in the sump 126 to accelerate the breaking of the UDP by hydraulic motion of stirring the water.

Figure 12:
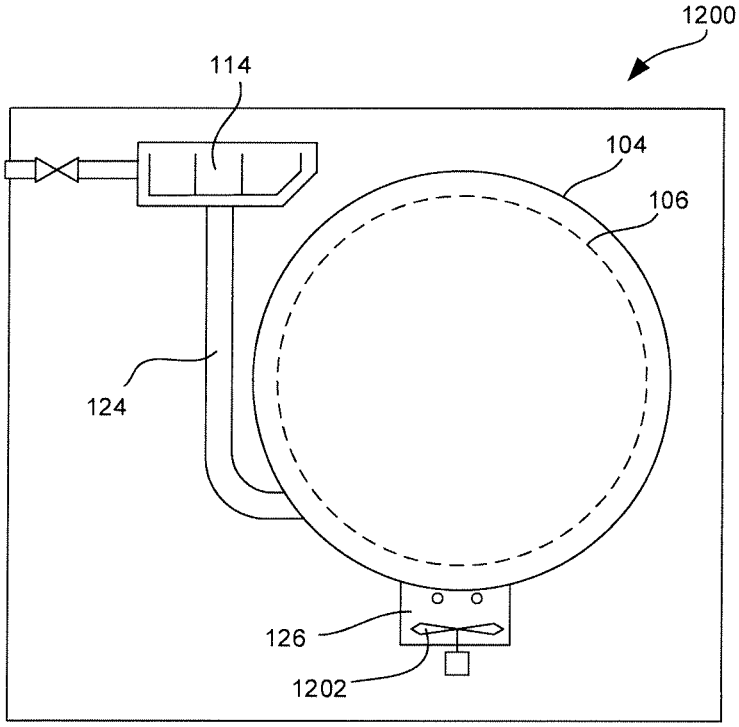
FIG. 12 is a schematic illustration of another embodiment of a washing machine.

FIG. 12 provides still another embodiment of a laundry washing machine 1200. In this case, a mechanical breaking device is provided in the form of a mixer 1202. The mixer 1202 is configured to rotate or reciprocate in the sump 126 in order to contact and mechanically break apart the UDP. The mixer 902 map be configured with one or more sharp blades or pins, or one or more blunt rods or paddles, to cut or tear apart the UDP. For example, the mixer 1202 may have one or more moving edges that spin or otherwise move within the sump 126. The mixer 1202 also may comprise angled blades that cause fluid circulation within the sump 126, which may be helpful to pull the UDP into the mixer 1202 and thoroughly mix the contents of the UDP with the water. The mixer 1202 also may comprise one or more blunt arms that beat against the UDP to break it apart.

The mixer 1202 may be operated by any suitable motor, such as an electric motor that is sealed from the liquid in the sump 126. The mixer 1202 also may comprise a magnetic part (e.g., an iron bar) that is rotated by a corresponding magnetic part (e.g., a rotatable permanent magnet or electromagnet) located outside the sump 126. This arrangement provides simple fluid isolation because it does not require a driveshaft to pass through the sump wall. It is also envisioned that the mixer 1202 may be located in other locations, such as in a reservoir located in the tub supply pipe 124 upstream of the tub 104. Other alternatives and variations will be apparent to persons of ordinary skill in the art in view of the present disclosure.

The foregoing embodiments are expected to provide several benefits. For example, breaking the UDP downstream of the additive loading and supply system 114 can provide flexibility in the selection of the mechanism that is used to break the UDP pouch, and can allow more latitude in the overall layout and design of the laundry washing machine. In still other cases, it may not be convenient or feasible to provide active UDP breaking inside the confines of an additive loading and supply system 114, in which case the foregoing embodiments provide potentially useful alternatives.

Figure 13:
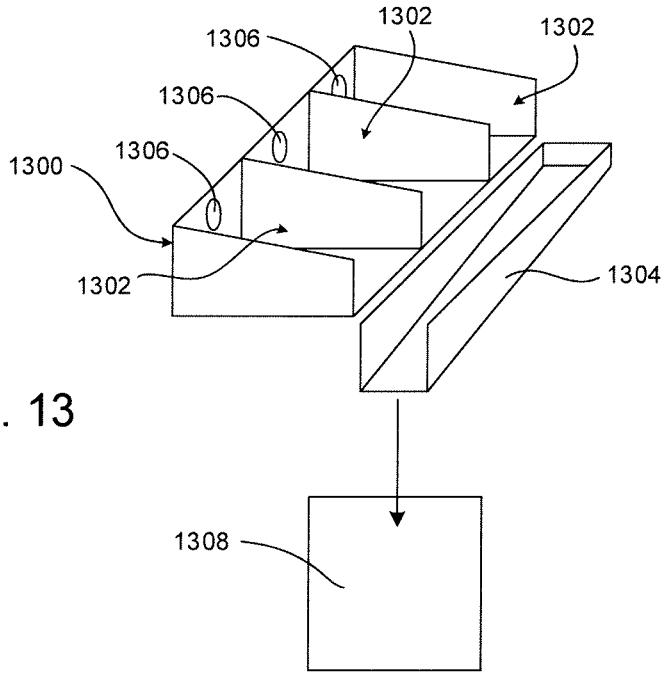
FIG. 13 is a schematic illustration of an additive loading and supply system.

Another benefit of breaking the UDP downstream of the additive loading and supply system is that a single breaking chamber may be used to open UDPs provided to the laundry washing machine at different locations. For example, as schematically illustrated in FIG. 13, an additive loading and supply system 1300 may have multiple separate compartments 1302, with each compartment 1302 being configured to receive a separate UDP. For example, a main wash compartment 1302 may contain a UDP with detergent composition, a second compartment 1302 may contain a UDP with a bleach composition, and a third compartment 1302 may contain a UDP with a fabric softener composition. The compartments 1302 all feed into a common tub supply pipe 1304.

The benefit of the arrangement in FIG. 13 is that multiple different UDPs can be loaded into a single additive loading and supply system 1300, and it is not necessary to provide a separate breaking means (mechanical or hydraulic) for each UDP compartment 1302. Instead, all of the UDPs are flushed down to a single breaking chamber 1308 or other breaking feature or mechanism that operates to break the UDPs. This can simplify the hydraulic system and the additive loading and supply system and provide other advantages.

The UDPs in the different compartments 1302 can be ejected into the tub supply pipe 1304 using any suitable mechanism. For example, each compartment 1302 may have a respective inlet nozzle 1306 that is attached to a hydraulic system. Valves (not shown) leading to the nozzles 1304 are selectively activated by a controller to flush the desired UDP into the tub inlet pipe 1304 at the desired time. Each nozzle 1304 is shown in a vertical wall of the associated compartment 1302, but the nozzles 1304 may be located elsewhere, such as above the associated compartment 1302. The nozzles 1304 also may be replaced by other devices, such as mechanical arms that eject the UDPs at the desired time.

Figure 14:
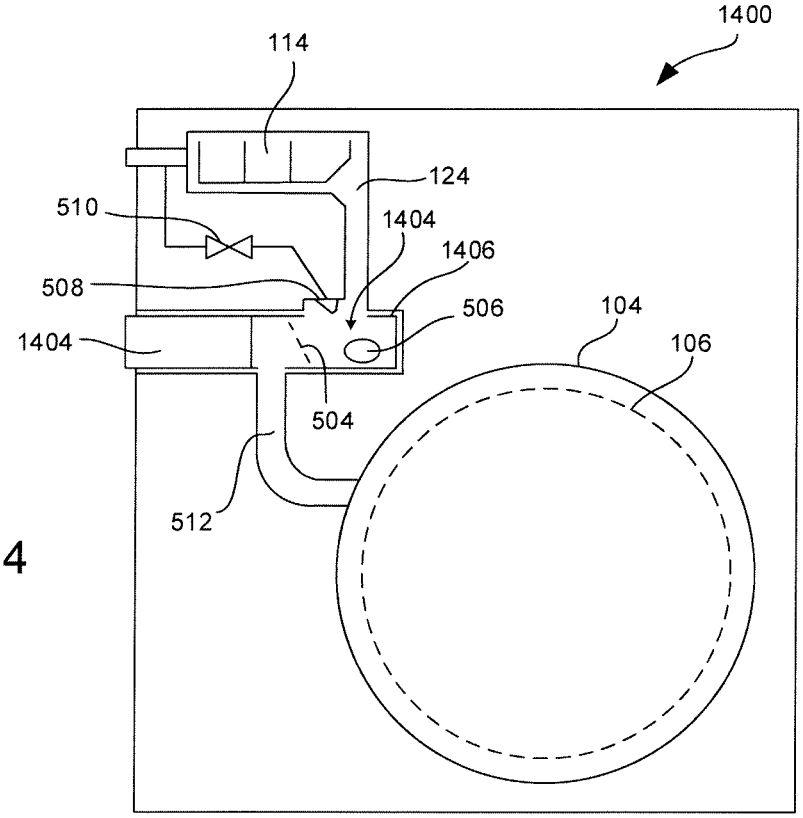
FIG. 14 is a schematic illustration of another embodiment of a washing machine.

Still another benefit of providing a UDP breaking system outside a conventional additive loading and supply system (i.e., an additive loading and supply system that receives loose detergent in powder, liquid or gel form) is that a separate UDP supply entrance may be provided. For example, the laundry washing machine 1400 shown in FIG. 14, is functionally similar to the embodiment of FIGS. 5 and 9, but the breaking chamber 1402 is provided in a removable drawer 1404. The drawer 1404 comprises a receptacle 1406 for holding the UDP 506, an upper opening that is sized to receive water from the first tub supply pipe 124 and the nozzle(s) 508, and a lower opening that connects the receptacle to the second tub supply pipe 512. The receptacle 1406 also may have a retainer 504 to hold the UDP 506 in place while water is being poured or sprayed on it. In this embodiment, and other embodiments that provide a separate UDP loading arrangement, it is not necessary for the first tub supply pipe 124 to be dimensioned to allow the UDP 506 to pass therethrough. Thus, the drawer 1404 my be located at the same vertical level as, or above, the conventional additive loading and supply system 114, and the first tub supply pipe 124 can have relatively small physical dimensions.

The embodiment of FIG. 14 also may be modified by providing a separate water supply that feeds to the drawer 1404, so that it need not be located downstream of a first tub supply pipe 124. The drawer 1404 also may be located below the level of the drum, and a separate pump may be provided to convey the detergent mixture from the drawer 1404 to the drum when desired. Other alternatives and variations will be apparent to persons of ordinary skill in the art in view of the present disclosure. For example, the drawer 1404 may be replaced by an openable door, or the like.

Figure 15:
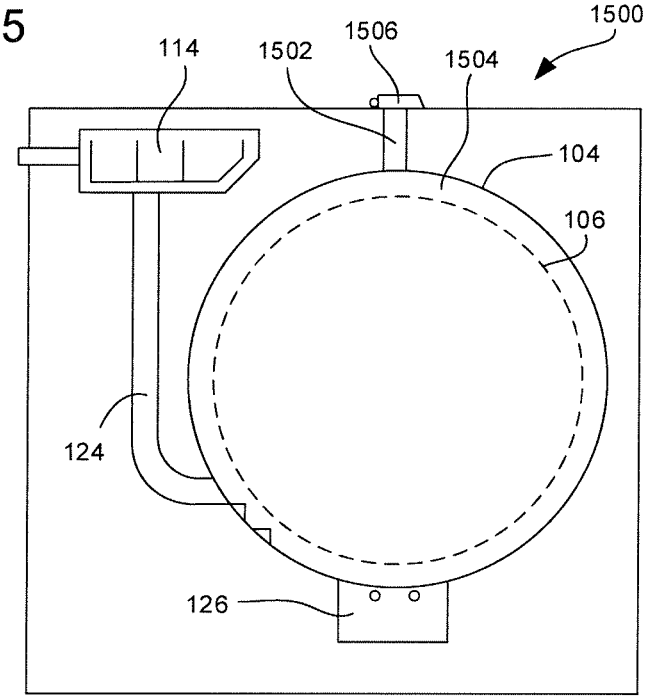
FIG. 15 is a schematic illustration of another embodiment of a washing machine.

In another example, shown in FIG. 15, a laundry washing machine 1500 may include a UDP loading port 1502 that leads to a space 1504 between the tub 104 and drum 106. In this embodiment, motion of the drum 106 can be used to break apart the UDP pouch, and the space 1504 may include device such as protrusions, blades and the like, such as discussed in relation to the embodiment of FIG. 8, to assist with disintegrating the UDP pouch. A cover 1506 may be provided over the UDP loading port 1502. This embodiment also may be modified to provide entry of the UDP to other parts of the laundry washing machine, such as directly to a sump 126, to a location along the tub supply pipe 124, and so on.

Figure 16A:
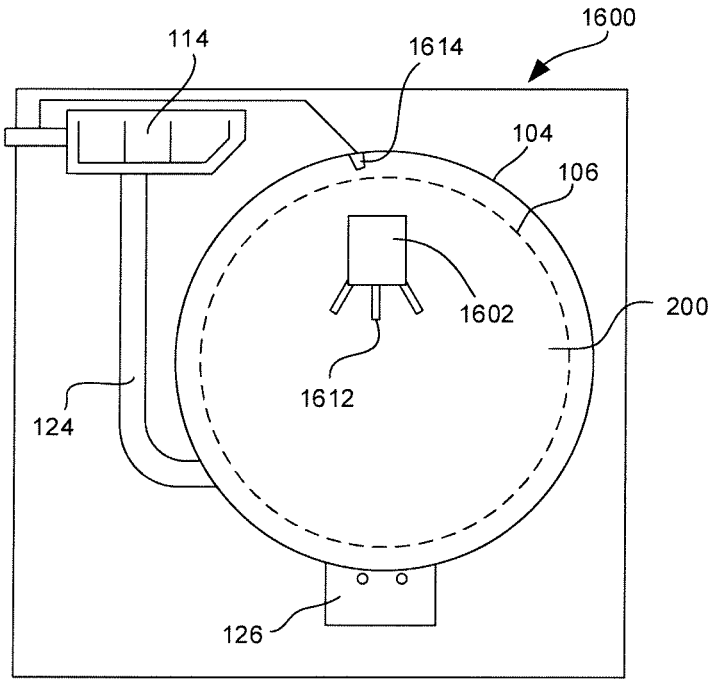
FIG. 16A is a schematic illustration of another embodiment of a washing machine.
Figure 16B:
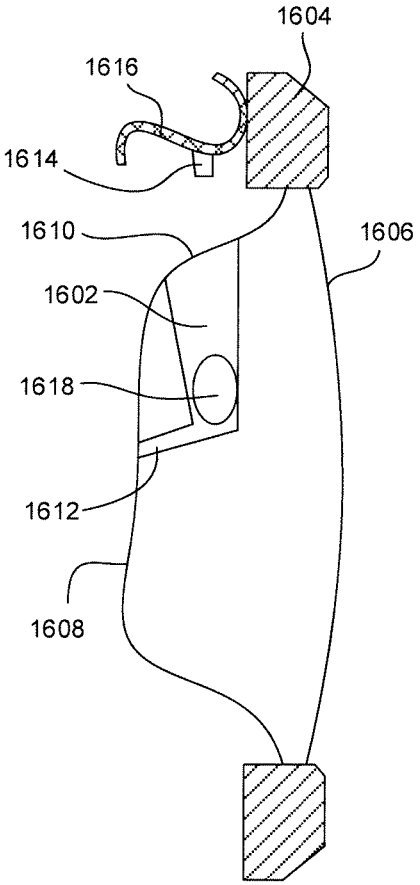
FIG. 16B is a cutaway side view of a door and related parts of the embodiment of FIG. 16A.

In still another example, shown in FIGS. 16A and 16B, a laundry washing machine 1600 may have a UDP loading chamber 1602 located in the drum door 200. In this example, the door 200 has a circular perimeter frame 1604 with an outer glass 1606 and an inner glass 1608 extending within the frame 1604. The UDP loading chamber 1602 is provided by a pocket in or on the inner glass 1608. The pocket may be molded as part of the inner glass 1608 or otherwise formed. The pocket has an open upper end 1610 and one or more fluid passages 1612 extending from the bottom end of the pocket to the interior of the drum 106. The upper end 1610 is positioned to receive a flow of water from one or more nozzles 1614. The nozzles 1614 may be located in a bellows seal 1616 or elsewhere. The UDP 1618 is loaded into the chamber 1602 while the door 200 is opened. The relatively small fluid passages 1612 prevent the UDP 1618 from falling into the drum 106 until the UDP 1618 breaks open.

Figure 17:
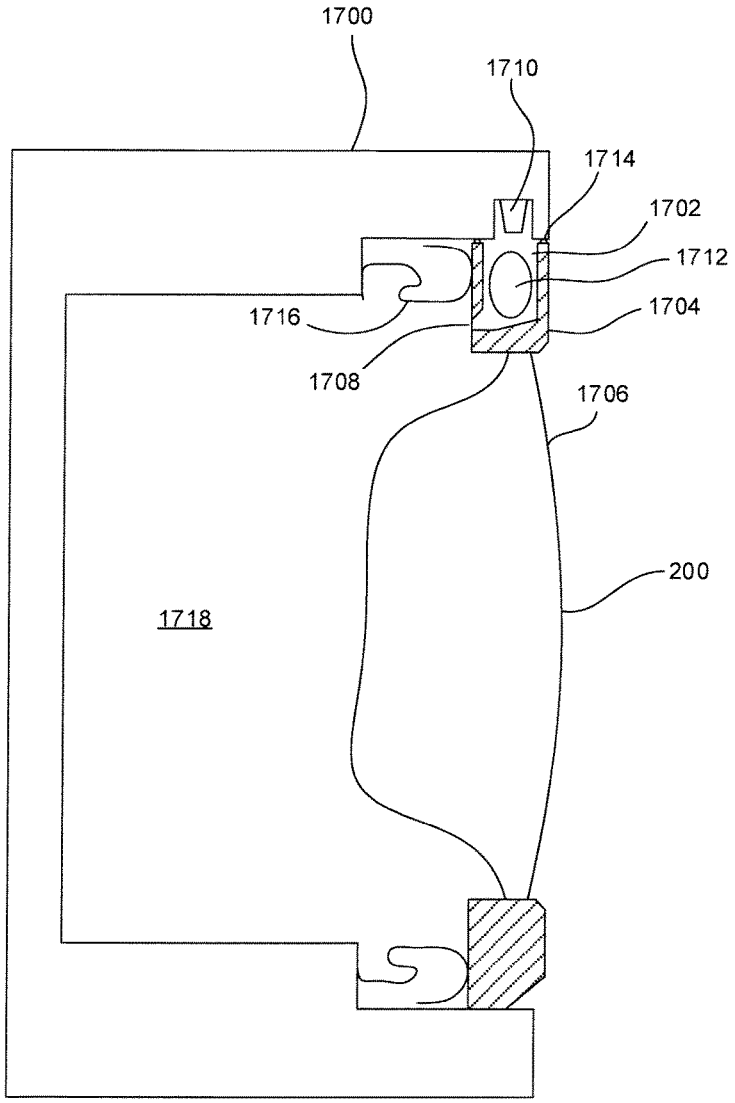
FIG. 17 is a schematic illustration of another embodiment of a washing machine.

FIG. 17 illustrates another example of a laundry washing machine 1700 in which a UDP loading chamber 1702 is provided in the drum door 200. In this case, the UDP loading chamber 1702 is provided in a frame 1704 of the door, rather than the glass 1706. The UDP loading chamber 1702 comprises a pocket in or on the frame 1704 that is sized to receive a UDP 1712. For example, the UDP loading chamber 1702 may comprise a downward depression located at an upper part of the frame 1704. One or more fluid passages 1708 extend from the UDP loading chamber 1702 to the interior of the drum 1718. One or more nozzles 1710 are provided to distribute water into the UDP loading chamber 1702. In the shown example, the nozzles 1710 are provided in the frame of the laundry washing machine surrounding the door frame 1704. However, the nozzles may be located within the door frame 1704 itself, and fluidly connected to a water supply via flexible hoses that pass through the door hinge or the like. One or more seals 1714 may be provided to prevent water from leaking out of the top of the UDP loading chamber 1702. The outlet fluid passages 1708 ay be located within the confines of a bellows seal 1716 that seals the door 200 against the open end of the drum 1718, but they may instead pass through or around the back side of the bellows seal 1716. The fluid outlet passages 1708 also may be located in the door glass 1706. When it is desired to cause the UDP 1712 to pass into the drum 1718, a valve (not shown) is operated to cause water to pass through the nozzles 1710 and into the UDP loading chamber 1702. After a sufficient amount of time or exposure to the water, the UDP will deform sufficiently to pass through the passages 1708. If desired, the nozzles 1710 may comprise laminar flow jets or the like to break apart the nozzle by physical force, but it is also envisioned that the water may simply dissolve the pouch. Other alternatives and variations will be apparent to persons of ordinary skill in the art in view of the present disclosure.

Figure 18:
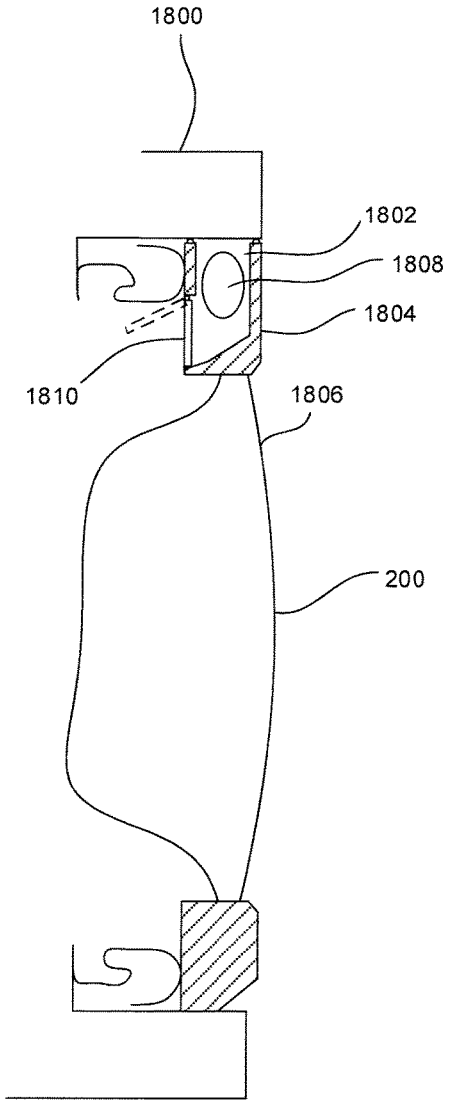
FIG. 18 is a schematic illustration of another embodiment of a washing machine.

FIG. 18 illustrates another example of a UDP loading chamber 1802 provided in the drum door 200. In this case, the UDP loading chamber is located in the door frame 1804, but it can alternatively be located in the door glass 1806. It will also be understood that in this an other embodiments, the door 200 may not have a glass 1806, and instead may have an opaque panel or the frame 1804 may extend continuously through the central region of the door 200. The UDP loading chamber 1802 is sized to receive a UDP 1808. The UDP loading chamber 1802 includes a cover 1810 at the bottom of the UDP loading chamber 1802. The cover 1810 is openable (such as shown in broken lines) to allow the UDP 1808 to fall into the drum. The cover 1808 may, for example, be spring-loaded to be biased towards the opened position, and retained in the closed position by a latch that is released by a solenoid or other mechanism when it is desired to release the UDP 1808 into the drum. Other alternatives and variations will be apparent to persons of ordinary skill in the art in view of the present disclosure.

Figure 19:
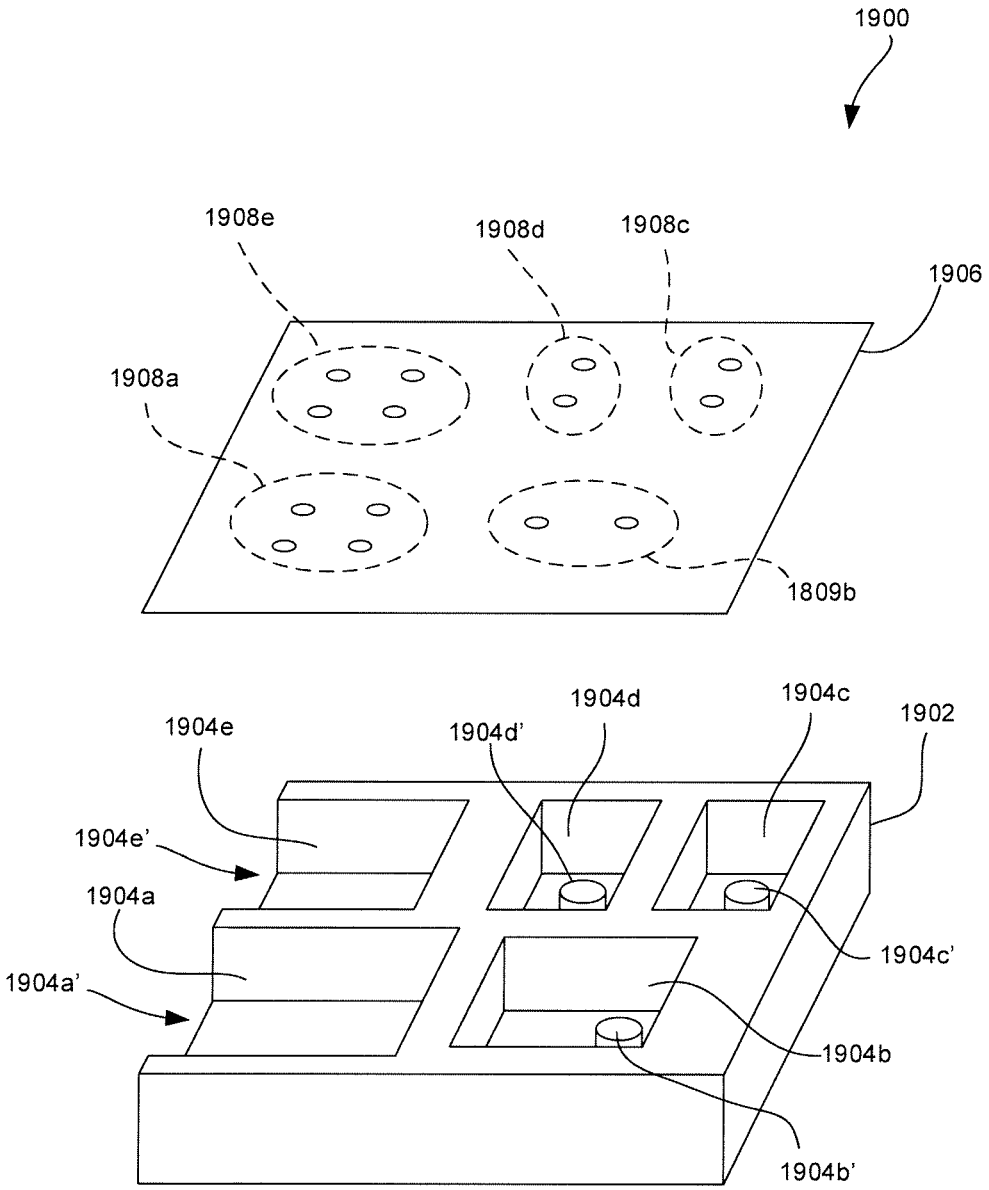
FIG. 19 is a schematic illustration of another additive loading and supply system.

FIG. 19 schematically illustrates another embodiment of an additive loading and supply system 1900. In this example, the additive loading and supply system 1900 has a receptacle 1902 (which may be a slidable drawer or a fixed chamber) with multiple additive compartments 1904. Such compartments may include, for example, a main wash detergent compartment 1904*a*, a stain treatment detergent compartment 1904*b*, a bleach compartment 1904*c*, and a fabric softener compartment 1904*d*. The main wash detergent compartment 1904*a* is configured to receive powdered and/or liquid detergent, and may have an open end 1904*a* ' to allow detergent or the like to flow into a tub supply pipe (not shown). Each of the other conventional compartments may include an associate siphon 1904*b*', 1904*c*', 1904*d*', or other configurations to allow the additive to leave the receptacle 1902, as known in the art.

In addition, the receptacle 1902 includes a separate UDP compartment 1904*e*, which is configured to receive detergent or other cleaning compositions in a UDP form. The UDP compartment 1904*e* preferably is sized to receive the UDP, and may have an open end 1904*e*' that connects to an associated tub supply pipe (not shown). In one embodiment, the open end 1904*e*' preferably is sized to allow an unbroken UDP to pass therethrough, such that it can be conveyed to a downstream breaking chamber by a flow of water into the UDP compartment 1904*e*. Alternatively, the UDP may be broken in the compartment, in which case it may be desirable to add a stopping member (e.g. a bar or peg) that prevents an unbroken UDP from passing though the open end 1904*e*'. The use of such a stopping member is optional, as it has been found that in at least some configurations friction can hold a UDP in a compartment without any stopping member being present, even while being subjected to a piercing water flow.

A cover 1906 encloses the top of the receptacle. The cover 1906 may be a top wall of an enclosure into which the receptacle slides (such as in the embodiment of FIG. 4), a wall that slides over or pivots to cover a fixed receptacle 1902, and so on.

Each compartment has one or more associated water supply outlets 1908, which may be formed as openings through the cover 1906 such as shown, or provided in other ways (e.g., openings through the sidewalls of the compartments 1904, etc.). A first set of one or more outlets 1908*a* provide water to the main wash detergent compartment 1904*a*, a second set of one or more outlets 1908*b* provide water to the stain treatment detergent compartment 1904*b*, a third set of one or more outlets 1908*c* provide water to the bleach compartment 1904*c*, a fourth set of one or more outlets 1908*d* provide water to the fabric softener compartment 1904*a*, and fifth set of one or more outlets 1908*e* provide water to the UDP compartment 1904*e*.

Using the foregoing embodiment, water can be selectively provided to a UDP compartment 1904*e* separately from the main wash detergent compartment 1904*a*. This provides the opportunity to customize the UDP compartment 1904*e* to provide more efficient and user-friendly operation. For example, the fifth set of one or more outlets 1908*e* may be provided as laminar flow jets to provide a concentrated flow to pierce the UDP, while the first set of one or more outlets 1904*a* may be provided as conventional sprayers to improve water distribution throughout the main wash detergent compartment 1904*a*. Other alternatives and variations will be apparent to persons of ordinary skill in the art in view of the present disclosure.

Figure 20A:
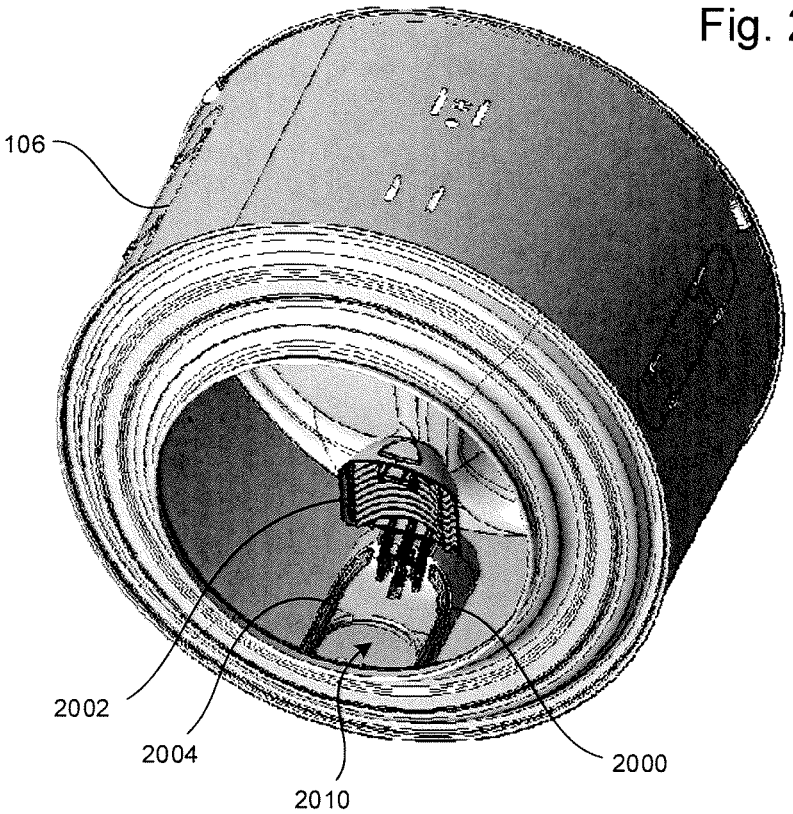
FIG. 20A to 20C illustrate another additive loading and supply system.
Figure 20B:
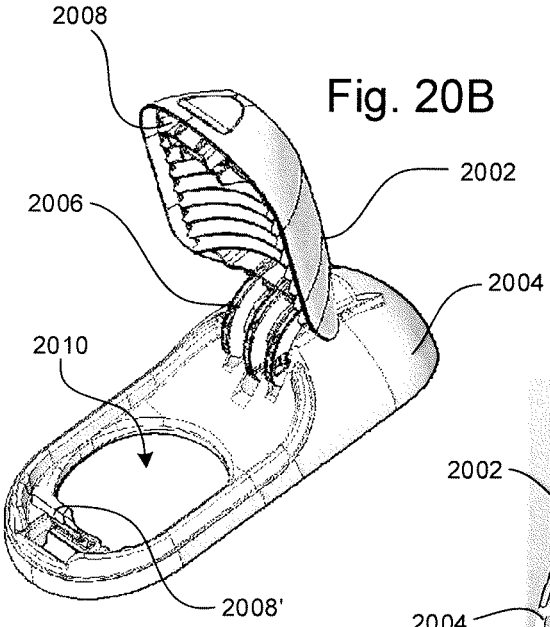
Figure 20C:
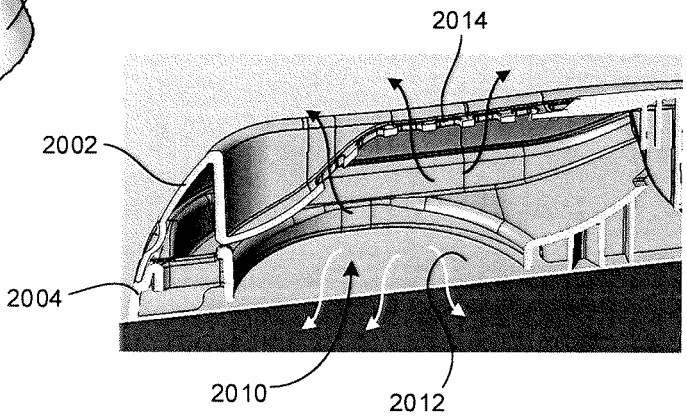

FIGS. 20A-20C illustrate another example of a laundry washing machine having a UDP compartment 2000 located inside the drum 106. The UDP loading compartment 2000 comprises a door 2002 that is connected to a base 2004 attached to the drum wall. A pivot 2006 joins the UDP loading door 2002 to the base 2004, and a spring (not shown) may be provided to bias the UDP loading door 2002 to a closed position. The pivot 2006 may comprise a virtual pivot formed by one or more semicircular tabs that extend from the door 2002 to slide in corresponding tracks in the base 2004, such as shown, but it may have other constructions.

A latch 2008, 2008' may be provided to releasably hold the UDP loading door 2002 in the closed position. Any suitable latch connection may be used, such as a resilient tab on the door 2002 that hooks around a protrusion on the base 2004 to form a snap fitment. When closed, the UDP loading door 2002 and base 2004 may be configured in the shape of a protrusion towards the interior of the drum 106, to act as a so-called "drum lifter" to help agitate and move the laundry during washing.

Together, the door 2002 and the base 2004 form a chamber 2010 that is shaped and sized to receive a UDP (not shown). A portion of the chamber 2010 also may be formed by a portion 2012 of the inner wall of the drum 106. The chamber 2010 has one or more openings 2014 that permit water to pass into and out of the chamber 2010. Such openings 2014 may be formed in the door 2002 (such as shown), the base 2004 and/or a portion 2012 of the drum 106 that forms part of the chamber 2010.

In use, an operator places a UDP into the chamber 2010 and closes the door 2002. After starting the laundry washing machine, water passes into the chamber 2010 through the openings 2014 to begin dissolving the UDP pouch and contents. The mixture of water and cleaning agents passes back through the openings 2014 to the drum 106 and the tub 104, and recirculates during the washing cycle. The chamber 2010 also may include one or more water jets to actively pierce the UDP pouch, such as discussed above. In one embodiment, the openings 2014 are sized such that the UDP cannot escape the chamber 2010 until it is fully dissolved. However, in another embodiment, one or more openings 2014 may be sized to allow the UDP to pass through after it has become partially dissolved.

In the foregoing example, the door 2002 is intended to remain closed throughout the washing cycle. In alternative embodiment, however, the door 2002 may be automatically opened during the washing cycle to release the UDP at the desired time. For example, a timer may elapse, or a electrical command may be issued based on sensed operating conditions, to operate a solenoid or motor to open the door 2002 at a specific time. In such an embodiment, the openings 2014 may be omitted to prevent the UDP from dissolving prior to the desired time. The door opening event may be controlled to prevent damage to the door 2002 by contact with the laundry, such as by requiring the drum 106 to be oriented with the UDP compartment 2000 at the vertical topmost position. The door 2002 also may be designed to have little or no likelihood of being damaged when opened. For example, the door 2002 may pivot inwards into the compartment space. Other alternatives and variations will be apparent to persons of ordinary skill in the art in view of the present disclosure.

The use of a UDP compartment 2000 inside the drum 106 is expected to provide various benefits. For example, the operation of the UDP loading system is simple and does not require significant modification to the operator's normal routine. Also, as compared to simply putting the UDP in the drum 106 after the laundry is loaded, these embodiments reduce the risk of undissolved detergent coming into contact with the laundry. These embodiments also allow the integration of a UDP loading system as a simple retrofit into existing designs and devices, and may be particularly useful in machines that do not have an external hot water inlet because the UDP can be exposed to heated water within the drum 106. Such embodiments are also expected to allow greater freedom in designing remaining aspects of a water distribution system.

It is also envisioned that the UDP compartment 2000 may be configured to allow a user access through the drum wall, to replace a filter located in the sump, such as shown in European Patent Application EP 2385166, which is incorporated herein by reference. For example, the portion 2012 of the drum 106 forming part of the chamber 2010 may have a port to allow access therethrough. In still another embodiment, the chamber 2010 may be omitted and replaced by an opening through the drum wall that allows the UDP to fall directly into the space between the drum 106 and the tub 104. Other features also may be used, as known in the art.

It will be appreciated that the laundry washing machines described in relation to FIG. 5 through 20C may also include various other features, such as laundry washing machine features known in the art and features such as those discussed in relation to FIGS. 1 through 4.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A laundry washing machine comprising:

a casing;

a washing tub located within the casing;

a drum mounted within the washing tub and configured to rotate relative to the casing;

a door attached to the casing and being openable to provide access to the drum;

an additive loading and supply system configured to receive loose detergent;

one or more valves configured to selectively provide water to the additive loading and supply system;

a tub supply pipe fluidly connecting the additive loading and supply system to the drum;

a receptacle configured to receive a unit dose package comprising a water soluble pouch containing a dose of cleaning product; and means for breaking the unit dose package outside the additive loading and supply system;

wherein the receptacle is located in the additive loading and supply system, and at least a first portion of the tub supply pipe is configured to pass an unbroken unit dose package therethrough; and wherein the means for breaking the unit dose package comprises a retainer fixed in place in the tub supply pipe, the retainer being configured to prevent an unbroken unit dose package from passing downstream through the tub supply pipe and allow only a broken unit dose package to pass downstream through the tub supply pipe; and wherein the means for breaking the unit dose package further comprises one or more knives or pins operatively associated with the retainer.

2. The laundry washing machine of claim 1, wherein the means for breaking the unit dose package further comprises one or more nozzles located adjacent to the retainer and configured to deposit water towards the retainer.

3. The laundry washing machine of claim 1, wherein the one or more knives or pins are movable to a position in which the one or more knives or pins contact the unit dose package retained by the retainer.

4. The laundry washing machine of claim 1, wherein the retainer comprises a receptacle configured to hold the unit dose package and a quantity of water therein.

5. The laundry washing machine of claim 4, wherein the means for breaking the unit dose package further comprises one or more nozzles configured to deposit water directly into the retainer.

6. The laundry washing machine of claim 1, wherein the tub supply pipe comprises a vertical shaft portion and the retainer is located in the vertical shaft portion, and the means for breaking the unit dose package further comprises water passing from the one or more valves and down the vertical shaft portion.

7. The laundry washing machine of claim 1, wherein the receptacle is located remotely from the additive loading and supply system.

8. The laundry washing machine of claim 7, wherein the laundry washing machine further comprises one or more nozzles configured to deposit water directly into the receptacle.

9. The laundry washing machine of claim 7, wherein the receptacle is located in the door.

10. The laundry washing machine of claim 7, wherein the receptacle comprises a drawer that intersects the tub supply pipe.

11. The laundry washing machine of claim 1, wherein the retainer comprises a chamber having a restriction in a cross-sectional shape or size dimensioned to prevent an unbroken unit dose package from passing downstream.

12. The laundry washing machine of claim 1, wherein the retainer comprises a perforated plate, a wire mesh, one or more rods, or ribs.

13. A laundry washing machine comprising:

a casing;

a washing tub located within the casing;

a drum mounted within the washing tub and configured to rotate relative to the tub;

a door attached to the casing and being openable to provide access to the drum;

an additive loading and supply system configured to receive loose detergent and supply the loose detergent and water to one of the tub and the drum;

one or more valves configured to selectively provide water to the additive loading and supply system;

a receptacle configured to receive a unit dose package comprising a water soluble pouch containing a dose of cleaning product and supply the unit dose package to the tub; and means for breaking the unit dose package positioned at a location inside the washing tub, and outside the receptacle and the drum;

wherein the means for breaking the unit dose package comprises one or more inwards protrusions extending from an inner wall of the washing tub towards the drum and/or one or more outwards protrusions extending from an outer wall of the drum towards the washing tub.

14. A laundry washing machine comprising:

a casing;

a washing tub located within the casing;

a drum mounted within the washing tub and configured to rotate relative to the tub;

a door attached to the casing and being openable to provide access to the drum;

an additive loading and supply system configured to receive loose detergent and supply the loose detergent and water to one of the tub and the drum;

one or more valves configured to selectively provide water to the additive loading and supply system;

a receptacle configured to receive a unit dose package comprising a water soluble pouch containing a dose of cleaning product and supply the unit dose package to the tub; and means for breaking the unit dose package positioned at a location inside the washing tub, and outside the receptacle and the drum;

wherein the means for breaking the unit dose package comprises a recirculation pump fluidly connected to the washing tub and configured to pump water from the washing tub and then back into the washing tub.

15. A laundry washing machine comprising:

a casing;

a washing tub located within the casing;

a drum mounted within the washing tub and configured to rotate relative to the tub;

a door attached to the casing and being openable to provide access to the drum;

an additive loading and supply system configured to receive loose detergent and supply the loose detergent and water to one of the tub and the drum;

one or more valves configured to selectively provide water to the additive loading and supply system;

a receptacle configured to receive a unit dose package comprising a water soluble pouch containing a dose of cleaning product and supply the unit dose package to the tub; and means for breaking the unit dose package positioned at a location inside the washing tub, and outside the receptacle and the drum;

wherein the washing tub comprises a sump at a lower end thereof, and the means for breaking the unit dose package comprises a mixer located in the sump.

* * * * *